US011195474B2

(12) United States Patent
Yoo et al.

(10) Patent No.: US 11,195,474 B2
(45) Date of Patent: Dec. 7, 2021

(54) DISPLAY DEVICE HAVING A COMPENSATION POWER GENERATOR FOR ADJUSTING INPUT VOLTAGES AND DRIVING METHOD THEREOF

(71) Applicant: LG DISPLAY CO., LTD., Seoul (KR)

(72) Inventors: Seung Jin Yoo, Paju-si (KR); Sang Jin Nam, Paju-si (KR); Hyun Suk Lee, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/902,792

(22) Filed: Jun. 16, 2020

(65) Prior Publication Data

US 2021/0043149 A1 Feb. 11, 2021

(30) Foreign Application Priority Data

Aug. 9, 2019 (KR) ..... 10-2019-0097741

(51) Int. Cl.
*G09G 3/3291* (2016.01)
*G09G 3/3258* (2016.01)

(52) U.S. Cl.
CPC ..... *G09G 3/3291* (2013.01); *G09G 3/3258* (2013.01); *G09G 2330/021* (2013.01)

(58) Field of Classification Search
CPC ..... G09G 3/3291
USPC ..... 345/76
See application file for complete search history.

(56) References Cited

U.S. PATENT DOCUMENTS

2015/0364077 A1* 12/2015 Liu ..... G09G 3/3696 345/691
2017/0154572 A1* 6/2017 Kim ..... G09G 3/3233
2018/0190196 A1* 7/2018 Kwon ..... G09G 3/3241
2018/0197480 A1* 7/2018 Choi ..... H04N 13/344

FOREIGN PATENT DOCUMENTS

KR 10-2010-0011642 A 2/2010
KR 10-2015-0079315 A 7/2015
KR 10-2019-0023509 A 3/2019

* cited by examiner

*Primary Examiner* — Long D Pham
(74) *Attorney, Agent, or Firm* — Birch, Stewart, Kolasch & Birch, LLP

(57) ABSTRACT

A display device and a driving method thereof are discussed. This display device receives first and second input reference voltages, generates gamma reference voltages having different voltage levels, receives each of the gamma reference voltages, and generates a data voltage of pixel data. The first and second input reference voltages and the reference voltage are changed according to a variation of the pixel driving voltage.

14 Claims, 24 Drawing Sheets

VG=VDD-VTH-(DATA-VREF)

DISPLAY DEVICE HAVING A COMPENSATION POWER GENERATOR FOR ADJUSTING INPUT VOLTAGES AND DRIVING METHOD THEREOF

CROSS-REFERENCE TO RELATED APPLICATION

This application claims priority to Korean Patent Application No. 10-2019-0097741, filed on Aug. 9, 2019 in the Republic of Korea, the disclosure of which is incorporated herein by reference in its entirety into the present application.

BACKGROUND

Field

The present disclosure relates to a display device and a driving method thereof.

Discussion of Related Art

Flat-panel display devices include a liquid crystal display (LCD), an electroluminescence display, a field emission display (FED), a plasma display panel (PDP), and the like.

An electroluminescence displays is classified as an inorganic light-emitting display device and an organic light-emitting display device according to the material of an emission layer. An active-matrix-type organic light-emitting display device includes an organic light-emitting diode (OLED) that emits light by itself and has advantages in terms of a fast response rate, high light emission efficiency, high luminance, and a large viewing angle.

An OLED of an organic light-emitting display device includes an organic compound layer formed between an anode and a cathode. An organic compound layer can include a hole injection layer HIL, a hole transport layer HTL, an emission layer EML, an electron transport layer ETL, and an electron injection layer EIL. When a voltage is applied to the anode and the cathode of the OLED, holes having passed through the hole transport layer HTL and electrons having passed through the electron transport layer ETL are moved to the emission layer EML to form excitons. As a result, the emission layer EML emits visible light.

SUMMARY

The screen of a display device can be enlarged, and different content images can be displayed on the screen. For example, a vehicle display device can have a large screen split into a first screen and a second screen, and the first screen, which is closer to a driver's seat, can be used as a navigation screen. A content image such as a movie or a broadcasting program, which is completely different from that of the navigation screen, can be displayed on the second screen which is viewed by a passenger in a passenger seat. For a display device in which light is emitted when current flows through light-emitting elements of pixels, when a scene change occurs on one of a first screen and a second screen, a luminance variation can occur on the other screen, and thus a user (a driver or a passenger) can perceive a flicker.

For a display device with a narrow bezel implemented therein, the width of lines formed in the bezel can be decreased. When the width of a line through which a pixel driving voltage VDD is applied is reduced, the variation of IR (current*resistor) increases with the change in current applied to the pixels, and thus the variation of luminance of the pixels can further increase. Such a luminance variation appears as a flicker.

The present disclosure is directed to solving or addressing the aforementioned needs and/or problems.

In one example, the present disclosure provides a display device capable of preventing flickers from appearing on one split screen among electrically connected split screens of a display panel when a scene change occurs on another screen, and provides a driving method of the display device.

It should be noted that objectives of the present disclosure are not limited to the above-described objectives, and other objectives that are not described herein will be apparent to those skilled in the art from the following descriptions.

According to an embodiment of the present disclosure, there is provided a display device including a pixel array including a data line through which a data voltage is supplied, a gate line through which a gate signal is supplied, and multiple pixel circuits; a first power supply line configured to supply a pixel driving voltage to the pixel circuits; a second power supply line configured to supply a low-potential power supply voltage lower than the pixel driving voltage to the pixel circuits; a third power supply line configured to supply a reference voltage for initializing the pixel circuits; a gamma reference voltage generation unit configured to receive first and second input reference voltages and generate gamma reference voltages having different voltage levels; a data driving unit configured to receive the gamma reference voltages, generate a data voltage of pixel data, and supply the data voltage to the data lines; and a compensation power generation unit configured to receive the pixel driving voltage through a feedback line connected to the pixel circuits or the first power supply line and change the reference voltage and the first and second input reference voltages according to a variation of the pixel driving voltage.

According to another embodiment of the present disclosure, there is provided a driving method of a display device, the driving method including supplying a pixel driving voltage (VDD), a low-potential power supply voltage (VSS), and a reference voltage (Vref) to pixel circuits; receiving first and second input reference voltages (REFH and REFL) and generating gamma reference voltages having different voltage levels; receiving the gamma reference voltages and generating a data voltage of pixel data; and changing the first and second input reference voltages (REFH and REFL) and the reference voltage (Vref) according to a variation of the pixel driving voltage.

BRIEF DESCRIPTION OF THE DRAWINGS

The above and other objects, features and advantages of the present disclosure will become more apparent to those of ordinary skill in the art by describing exemplary embodiments thereof in detail with reference to the attached drawings, in which.

DETAILED DESCRIPTION OF THE EMBODIMENTS

Figure 1:
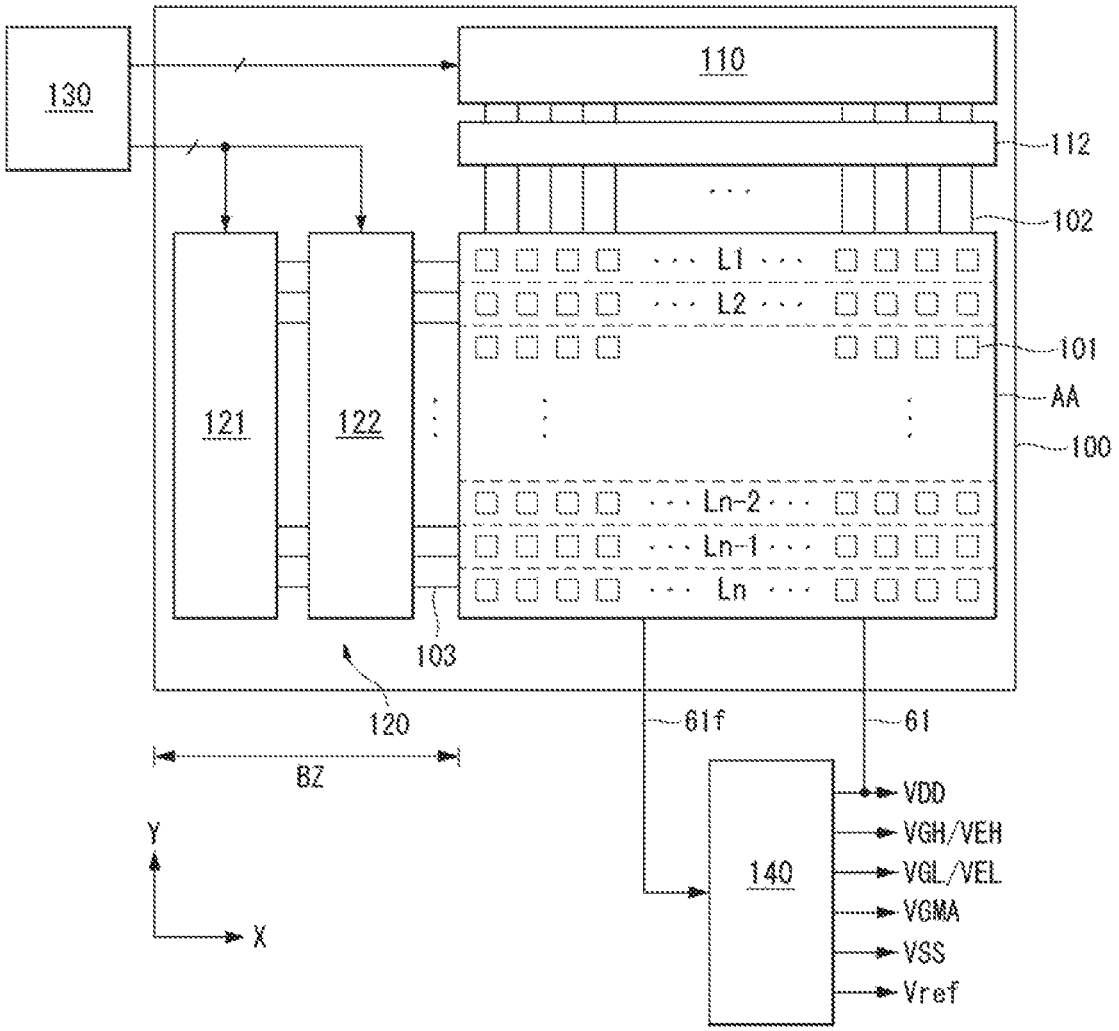
FIG. 1 is a block diagram showing a display device according to an embodiment of the present disclosure.

Advantages and features of the present disclosure, and implementation methods thereof will be clarified through the following embodiments described with reference to the accompanying drawings. The disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Therefore, the scope of the disclosure is defined only by the appended claims.

The figures, dimensions, ratios, angles, numbers, and the like disclosed in the drawings for describing the embodiments of the present disclosure are merely illustrative and are not limited to matters shown in the present disclosure. Like reference numerals refer to substantially like elements throughout. Further, in describing the present disclosure, detailed descriptions of well-known technologies will be omitted when it is determined that they can unnecessarily obscure the gist of the present disclosure.

Terms such as "provided," "including" "having," and "formed" used herein are intended to allow other elements to be added unless the terms are used with the term "only." Any references to singular can include plural unless expressly stated otherwise.

Components are interpreted to include an ordinary error range even if not expressly stated.

For description of a positional relationship, for example, when the positional relationship between two parts is described as "on," "above," "below," and "next to," etc., one or more parts can be interposed therebetween unless the term "immediately" or "directly" is used in the expression.

The terms "first," "second," etc. can be used to classify the components, but the functions or structures of the components are not limited by the ordinal numbers or the names of the components. These terms may not define any order.

The following embodiments can be partially or entirely combined with each other, and technically various interlocking and driving are possible. The embodiments can be carried out independently of or in association with each other.

A display device according to one or more embodiments of the present disclosure includes a plurality of pixels for displaying images, and can be any type of display device. For color representation, each pixel is divided into multiple sub-pixels having different colors, and each sub-pixel includes a transistor used as a switching element or a driving element. The driving circuit of the display device writes pixel data of an input image to the pixels. The driving circuit of the flat panel display device includes a data driving unit configured to supply a data signal to data lines, a gate driving unit configured to supply a gate signal to gate lines, and the like. A gate driving unit and a pixel circuit in a display device of the present disclosure can each include multiple transistors and can be formed directly on a substrate of a display panel.

Such a transistor can be implemented as a thin film transistor (TFT) with a metal-oxide-semiconductor field-effect transistor (MOSFET) structure. A transistor can be implemented as an oxide TFT including an oxide semiconductor or a low-temperature polysilicon (LTPS) TFT including LTPS.

Generally a transistor is a three-electrode element including a gate, a source, and a drain. The source is an electrode through which carriers are supplied to the transistor. In the transistor, carriers begin to flow from the source. The drain is an electrode through which carriers exit the transistor. The flow of carriers in the transistor is directed from the source to the drain. In the case of an n-channel transistor, the carriers are electrons. Thus, a source voltage is lower than a drain voltage so that the electrons can flow from the source to the drain. In an n-channel transistor, a current flows from the drain to the source. In the case of a p-channel transistor, the carriers are holes. Thus, the source voltage is higher than the drain voltage so that the holes can flow from the source to the drain. Since the holes in the p-channel transistor flow from the source to the drain, a current flows from the source to the drain. It should be noted that the source and drain of the transistor are not fixed. For example, the source and drain can be changed depending on an applied voltage. Accordingly, the present disclosure is not limited by the source and drain of the transistor. In the following description, the source and drain of the transistor will be referred to as first and second electrodes, respectively.

A gate signal can transition between a gate-on voltage and a gate-off voltage. The transistor is turned on when the gate-on voltage is applied to the gate. The transistor is turned off when the gate-off voltage is applied to the gate.

In the case of an n-channel transistor, the gate-on voltage can be a gate high voltage VGH or VEH, and the gate-off voltage can be a gate low voltage VGL or VEL. In the case of a p-channel transistor, the gate-on voltage can be a gate low voltage VGL or VEL, and the gate-off voltage can be a gate high voltage VGH or VEH. The following embodiments will be described focusing on an example in which a pixel circuit has transistors implemented as p-channel transistors. However, it should be noted that the present disclosure is not limited thereto.

The gate signal can include an emission control signal (hereinafter also referred to as an "EM" signal) and a scan signal for the organic light-emitting display device. In the following embodiments, VGL and VGH refer to gate signal voltages of the scan signal. VEL and VEH refer to gate signal voltages of the EM signal.

Hereinafter, embodiments of the present disclosure will be described in detail with reference to the accompanying drawings. The following embodiments will be described focusing on a case in which an electroluminescence display is an organic light-emitting display device. The technical spirit of the present disclosure is not limited to the organic light-emitting display device and can be applied to an inorganic light-emitting display including an inorganic light-emitting material.

Figure 2:
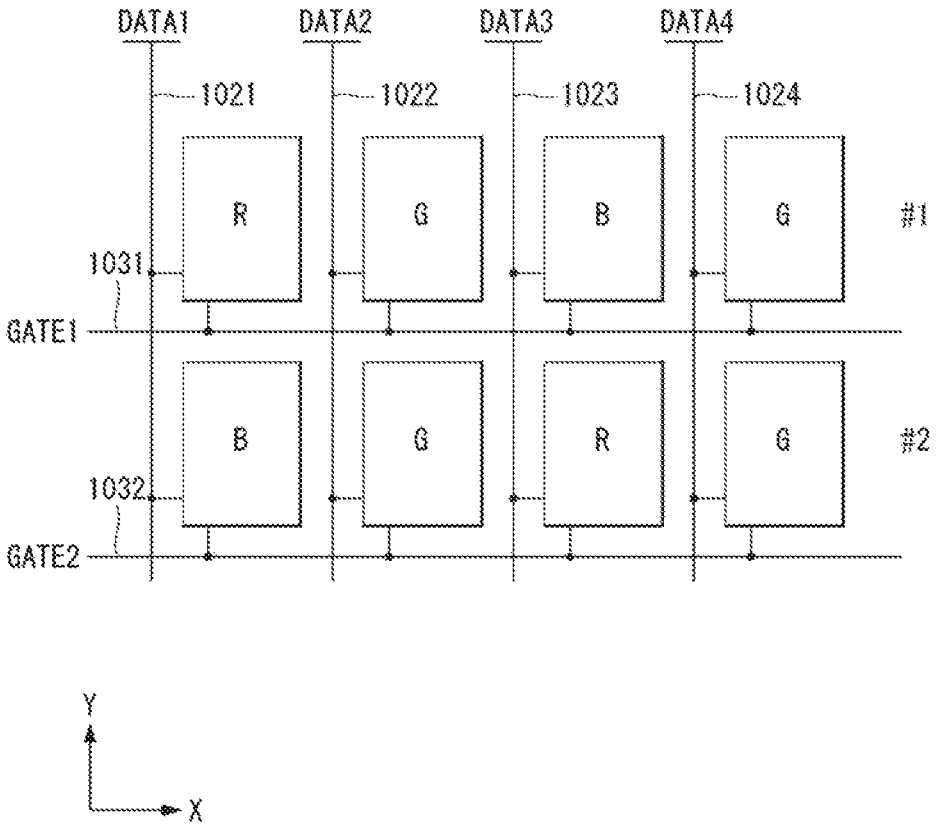
FIG. 2 is a diagram showing an example of a pentile pixel arrangement.
Figure 3:
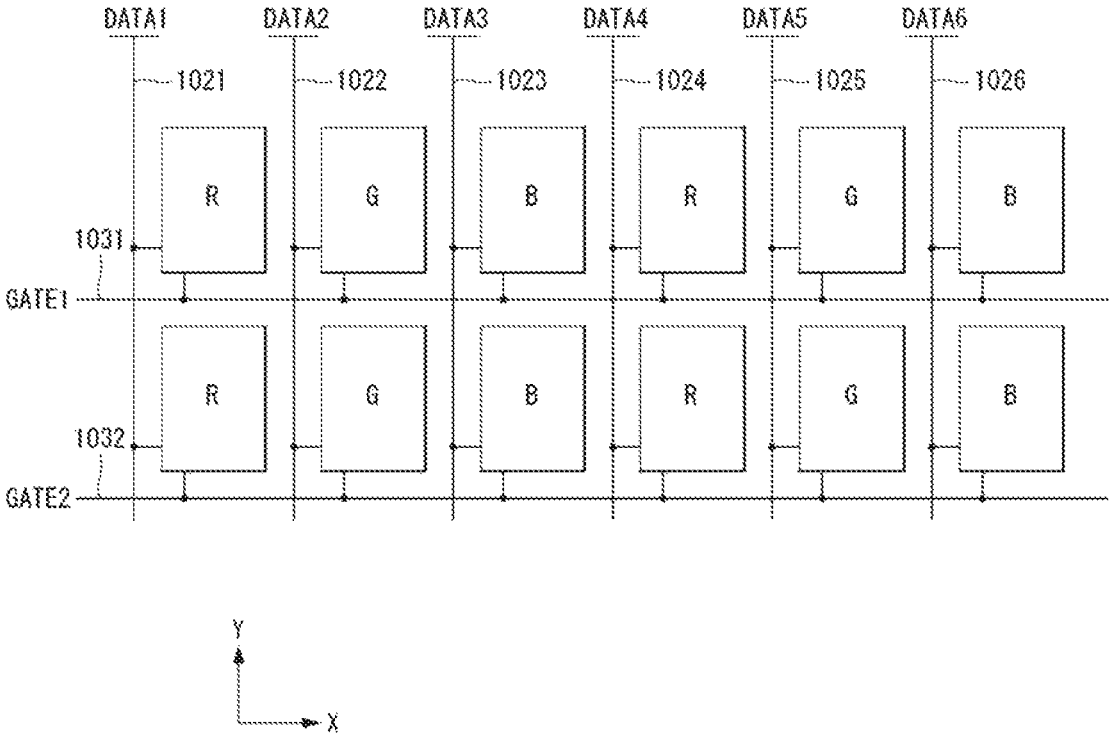
FIG. 3 is a diagram showing an example of a real color pixel arrangement.
Figure 4:
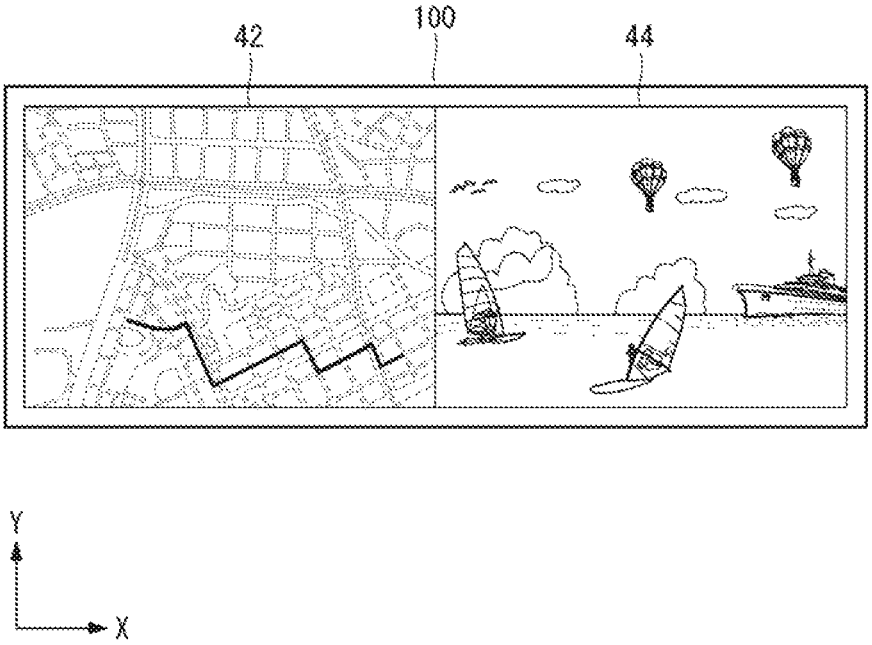
FIG. 4 is a diagram showing an example in which different content images are independently displayable on a first screen and a second screen slit from one screen.
Figure 5:
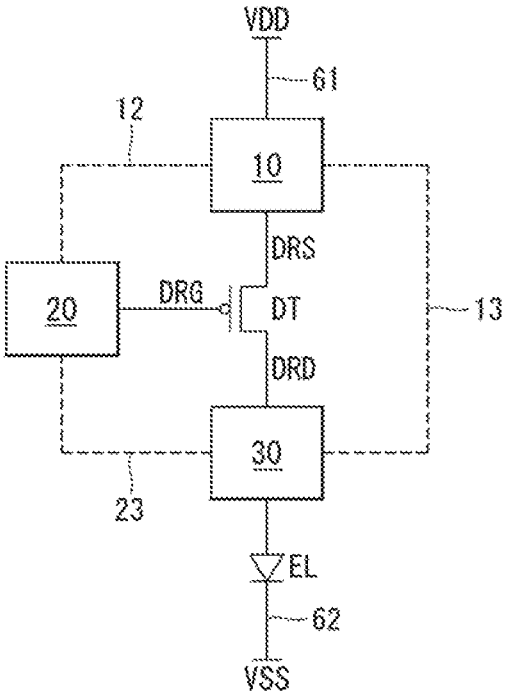
FIG. 5 is a schematic diagram showing a pixel circuit of the present disclosure.

FIG. 1 is a block diagram showing a display device according to an embodiment of the present disclosure, FIG. 2 is a diagram showing an example of a pentile pixel arrangement, FIG. 3 is a diagram showing an example of a real pixel arrangement, FIG. 4 is a diagram showing an example in which different content images are independently displayable on a first screen and a second screen slit from one screen, and FIG. 5 is a schematic diagram showing a pixel circuit of the present disclosure;

Referring to FIGS. 1 to 5, the display device according to an embodiment of the present disclosure includes a display panel 100, a display panel driving circuit for writing pixel data to pixels of the display panel 100, and a power supply unit 140 configured to generate power necessary to drive the pixels and the display panel driving circuit.

The display panel 100 includes a pixel array AA that displays an input image. The pixel array AA has a screen including multiple data lines 102 and 1021 to 1026, multiple gate lines 103, 1031, and 1032 intersecting the data lines 102 and 1021 to 1026, and pixels arranged in a matrix form. The pixel array AA includes multiple pixel lines L1 to Ln.

The screen of the display panel 100 can be split into two or more screens. For example, as shown in FIG. 4, the screen can be split into first and second screens 42 and 44. A navigation map can be displayed on the first screen 42. An image of audio/video content selected by a passenger seated in a passenger seat can be displayed on the second screen 44.

The split screens 42 and 44 can share power supply lines such as a first power supply line 61 (see FIG. 8) through which a pixel driving voltage VDD is applied, a second power supply line 62 (see FIG. 8) for supplying a low-potential power supply voltage VSS to pixels, and a third power supply line 63 (see FIG. 8) for supplying a reference voltage Vref to the pixels. The gate lines 103, 1031, and 1032 can be shared by the split screens 42 and 44 or can be separated at a boundary between the split screens 42 and 44.

Each of pixel lines L1 to Ln includes one line of pixels arranged in the pixel array AA of the display panel 100 in a line direction X. Pixels arranged in one pixel line share the gate lines 103, 1031, and 1032. Sub-pixels arranged in a column direction Y and a data line direction share the same data lines 102 and 1021 to 1026. One horizontal period 1H is a period obtained by dividing one frame period by the total number of pixel lines L1 to Ln.

The display panel 100 can be produced as a flexible display panel. The flexible display panel can be produced on a plastic substrate base. A plastic OLED panel has a pixel array AA formed on an organic thin film adhered to a back plate.

The back plate of the plastic OLED can be a polyethylene terephthalate (PET) substrate. The organic thin film is formed on the back plate. The pixel array AA and a touch sensor array can be formed on the organic thin film. The back plate blocks permeation of moisture to the organic thin film so that the pixel array AA is not exposed to humidity. The organic thin film can be a thin polyimide (PI) film substrate. A multilayer buffer film can be formed on the organic thin film and formed of an insulating material. Lines for supplying power or signals applied to the pixel array AA and the touch sensor array can be formed on the organic thin film.

For color representation, each of the pixels can be divided into a red sub-pixel (hereinafter referred to as an "R sub-pixel"), a green sub-pixel (hereinafter referred to as a "G sub-pixel"), and a blue sub-pixel (hereinafter referred to as a "B sub-pixel"). Each of the pixels can further include a white sub-pixel. Each of the sub-pixels 101 includes a pixel circuit. Hereinafter, a pixel can be considered synonymous with a sub-pixel.

The pixels can be arranged in the form of real color pixels or pentile pixels. The pentile pixels can implement higher resolution than the real color pixels by driving two sub-pixels with different colors as one pixel, as shown in FIG. 2, by using a preset pentile pixel rendering algorithm. The pentile pixel rendering algorithm compensates the color of light emitted in an adjacent pixel for the lack of color in each pixel.

For the real color pixels, one pixel can be composed of R, G, and B sub-pixels, as shown in FIG. 3.

A pixel circuit of each of the sub-pixels 101 is connected to the data lines 102 and 1021 to 1026 and the gate lines 103, 1031, and 1032.

Figure 8:
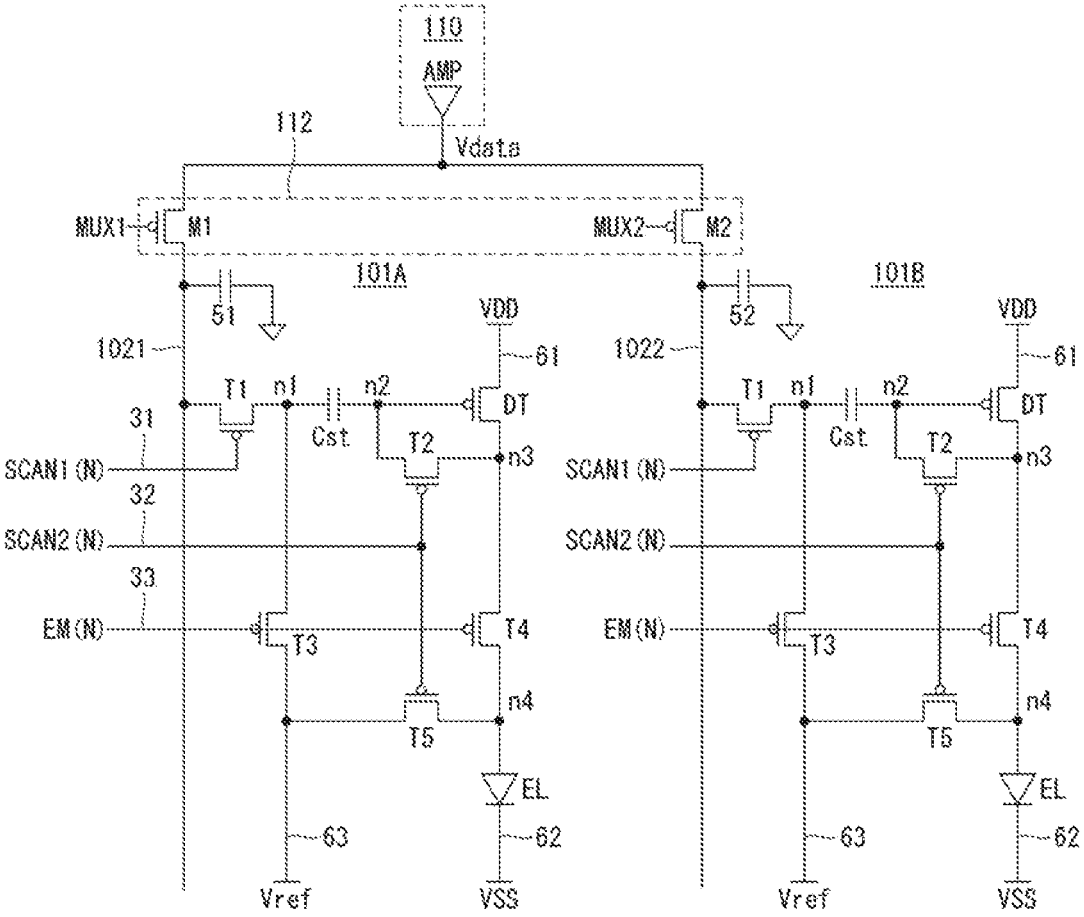
FIG. 8 is a detailed circuit diagram showing an example of the pixel circuit.

The pixel circuit can include a light-emitting element, a driving element, one or more switch elements, and a capacitor. Each of the driving element and the switch elements can be implemented as a transistor. The transistors of the pixel circuit can be implemented based on a p-channel TFT as shown in FIG. 8, but the present disclosure is not limited thereto.

As shown in FIG. 5, the pixel circuit can include first to third circuit units 10, 20, and 30 and first to third connection units 12, 23, and 13. One or more elements can be omitted from or added to the pixel circuit.

The first circuit unit 10 supplies the pixel driving voltage VDD to a driving element DT. The driving element DT is a transistor including a gate DRG, a source DRS, and a drain DRD. The second circuit unit 20 charges a capacitor Cst connected to the gate DRG of the driving element DT and maintains the voltage of the capacitor Cst during one frame period. The third circuit unit 30 provides current supplied from the pixel driving voltage VDD through the driving element DT to the light-emitting element EL to convert the current into light. The first connection unit 12 connects the first circuit unit 10 and the second circuit unit 20. The second connection unit 23 connects the second circuit unit 20 and the third circuit unit 30. The third connection unit 13 connects the third circuit unit 30 and the first circuit unit 10.

The gate DRG of the driving element DT should be initialized or reset periodically, for example, once every frame period, to prevent crosstalk due to the previous data voltage Vdata remaining as residual charges. To this end, a reference voltage for periodically initializing or resetting the gate DRG of the driving element DT is supplied. The reference voltage can be interpreted as an initialization voltage, a reset voltage, or the like.

Touch sensors can be arranged on the display panel 100. A touch input can be sensed using separate touch sensors or through the pixels. The touch sensors can be implemented as on-cell type or add-on type touch sensors, which are arranged on a screen of a display panel, or can be implemented as in-cell type touch sensors, which are embedded in a pixel array AA.

The power supply unit 140 generates DC power necessary to drive the display panel driving circuit and the pixel array AA of the display panel 100 using a DC-DC converter. The DC-DC converter can include a charge pump, a regulator, a buck converter, a boost converter, a buck-boost converter, and the like. The power supply unit 140 can generate DC voltages such as a gamma reference voltage VGMA, gate-on voltages VGL and VEL, gate-off voltages VGH and VEH, a pixel driving voltage VDD, a low-potential power supply voltage VSS, and a reference voltage Vref by adjusting a DC input voltage received from a host system. The gamma reference voltage VGMA is supplied to the data driving unit 110. The gate-on voltages VGL and VEL and the gate-off voltages VGH and VEH are supplied to the gate driving unit 120. The pixel driving voltage VDD, the low-potential power supply voltage VSS, and the reference voltage Vref can be supplied in common to the pixels. Hereinafter, the pixel driving voltage VDD, the low-potential power supply voltage VSS, and the reference voltage Vref can be referred to as VDD, VSS, and Vref, respectively.

The gate voltages VGH, VEH, VGL, and VEL can be set to 15 V, 13 V, −6 V, and −6 V, respectively, but the present disclosure is not limited thereto. The pixel power supply voltages VDD and VSS can be set to 13 V and 0 V, respectively, but the present disclosure is not limited thereto. The voltage range of the data voltage Vdata determined by the gamma reference voltage VGMA can range from 0 V to 5 V, but the present disclosure is not limited thereto. The reference voltage Vref is a voltage for initializing main nodes of the pixel circuit. The reference voltage Vref is set to a voltage with a difference between Vref and VSS being smaller than the threshold voltage of the light-emitting element EL such that the light-emitting element EL does not emit light when the pixel circuit is initialized.

In order to reduce a screen luminance variation ΔL when a scene change occurs on one of the split screens 42 and 44, one or both of the gamma reference voltage VGMA and Vref can vary in coordination with a change ΔVDD of VDD applied to the pixels of the screen. When a scene change occurs, VDD can increase or decrease due to a change in current. In this case, the power supply unit 140 increases one or both of the gamma reference voltage VGMA and Vref when the VDD voltage is fed back to increase VDD. When VDD decreases due to a change in current when a scene change occurs, the power supply unit 140 lowers one or both of the gamma reference voltage VGMA and Vref according to the VDD fed back.

The power supply unit 140 can change one or both of the reference voltage Vref of the pixel circuits and the gamma reference voltage VGMA according to the variation of the pixel driving voltage VDD input through a VDD line, a first power supply line 61, or a VDD feedback line **61*f*** on a printed circuit board (PCB) using a feedback compensation power generation unit which will be described below.

The power supply line 61 is formed on the substrate of the display panel 100 and connected to the pixel circuits, and is connected to the power supply unit 140 through the VDD line formed on the PCB on which the power supply unit 140 and a timing controller 130 are mounted. The power supply unit 140 can receive, as a feedback input, VDD through the VDD line on the PCB and change one or both of the reference voltage Vref of the pixel circuits and the gamma reference voltage VGMA according to the variation of the pixel driving voltage VDD.

The display panel driving circuit writes pixel data (digital data) of an input image to pixels of the display panel 100 under the control of the timing controller (TCON) 130.

The display panel driving circuit can have a data driving unit 110 and a gate driving unit 120. The display panel driving circuit can further include a demultiplexer array 112 disposed between the data driving unit 110 and data lines 102 and 1021 to 1026.

The demultiplexer array 112 can reduce the number of channels of the data driving unit 110 by sequentially connecting one channel of the data driving unit 110 to multiple data lines 102 and 1021 to 1026 and time-divisionally distributing a data voltage output from one channel of the data driving unit 110 to the data lines 102 and 1021 to 1026. Each channel of the data driving unit 110 outputs the voltage of a data signal (hereinafter referred to as "data voltage") through an output buffer AMP shown in FIG. 6.

The demultiplexer array 112 can be omitted. In this case, the output buffers AMP of the data driving unit 110 are directly connected to the data lines 102 and 1021 to 1026.

The display panel driving unit can further include a touch sensor driving unit for driving the touch sensors. The touch sensor driving unit is omitted from FIG. 1. For mobile devices, the timing controller 130, the power supply unit 140, the data driving unit 110, the touch sensor driving unit, and the like can be integrated into one drive integrated circuit (IC).

The display panel driving circuit can operate in a low-speed driving mode. The low-speed driving mode can be set to analyze an input image and reduce power consumption of a display device when the input image has not changed the preset number of frames. In the low-speed driving mode, by lowering a refresh rate of pixels when a still image is input for a certain time or more, it is possible to reduce power consumption of the display panel 100 and the display panel driving circuit. The low-speed driving mode is not limited to when a still image is input. For example, when the display device operates in a standby mode or when a user command or an input image is not input to the display panel driving circuit for a certain period or more, the display panel driving circuit can operate in the low-speed driving mode.

The data driving unit 110 converts pixel data of the input image, which is received from the timing controller 130 every frame period, into a gamma compensation voltage using a digital-to-analog converter (DAC) and outputs a data voltage Vdata. The gamma reference voltage VGMA is divided through a voltage divider circuit on a grayscale basis. The gamma compensation voltage obtained by dividing the gamma reference voltage VGMA is provided to the DAC of the data driving unit 110. The gamma reference voltage GMA is divided between first and second input reference voltages REFH and REFL in the following embodiment. As an example, the gamma reference voltage GMA includes first to ninth gamma reference voltages that are different from each other, but the present disclosure is not limited thereto.

Figure 6:
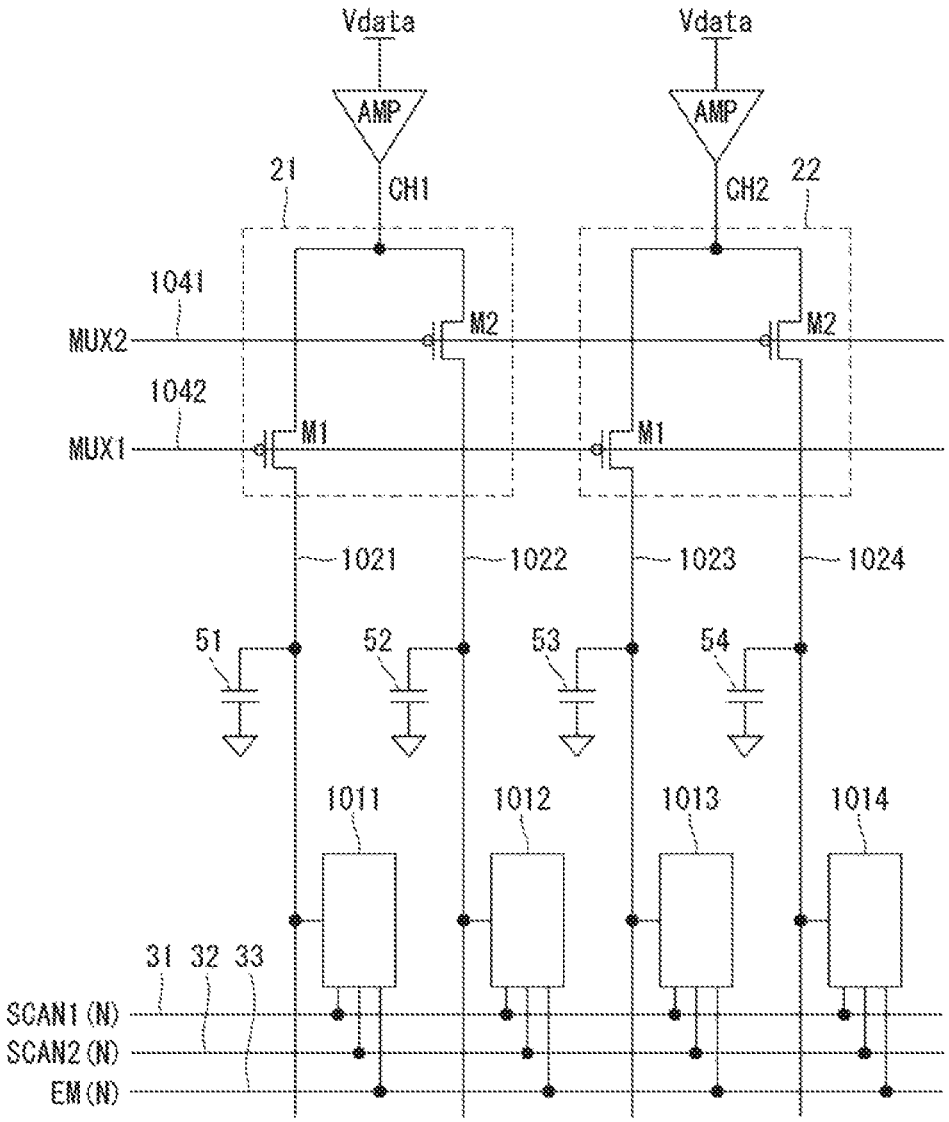
FIG. 6 is a detailed circuit diagram showing switch elements of a demultiplexer.

The output buffer AMP of the data driving unit 110 can be connected to the neighboring data lines 1021 to 1024 through the demultiplexer array 112, as shown in FIG. 6. As shown in FIG. 6, the demultiplexer array 112 includes multiple demultiplexers 21 and 22.

The demultiplexers 21 and 22 can be 1:N demultiplexers having one input node and N (N is a positive integer greater than or equal to two) output nodes. The demultiplexers 21 and 22 of the demultiplexer array 112 are illustrated as 1:2 demultiplexers in FIG. 6, but the present disclosure is not limited thereto. For example, the demultiplexers 21 and 22 can be implemented as 1:N demultiplexers and configured to sequentially connect one channel of the data driving unit 110 to N data lines. The demultiplexer array 112 can be directly formed on the substrate of the display panel 100 or can be integrated into one drive IC together with the data driving unit 110.

As shown in FIG. 6, capacitors 51 to 54 can be connected to the data lines 1021 to 1024, respectively. The capacitors 51 to 54 are charged by sampling the data voltage Vdata applied to the data lines 1021 to 1024 through the demultiplexers 21 and 22. The data voltage Vdata with which the capacitors 51 to 54 are charged is supplied to the pixel circuits 1011 to 1014 of the sub-pixels 101. The capacitors 51 to 54 can be implemented as separate capacitors formed with predetermined design values or parasitic capacitance of the data lines 1021 to 1024.

The gate driving unit 120 can be implemented as a gate-in-panel (GIP) circuit that is directly formed on a bezel region (BZ) of the display panel 100 together with a TFT array of the pixel array A. The gate driving unit 120 sequentially outputs a gate signal to the gate lines 103 under the control of the timing controller 130. By shifting the gate signal using a shift register, the gate driving unit 120 can sequentially supply signals obtained through the shift to the gate lines 103.

The gate signal can include an emission control signal (hereinafter also referred to as an "EM" signal) for defining an emission time of the pixels charged with the data voltage and a scan signal synchronized with the data voltage to select pixels of a line to which data is to be written.

The gate driving unit 120 can include a first gate driving unit 121 and a second gate driving unit 122. The first gate driving unit 121 outputs scan signals SCAN1 and SCAN2 in response to a shift clock and a start pulse received from the timing controller 130 and shifts the scan signals SCAN1 and SCAN2 according to a shift clock timing. The second gate driving unit 122 outputs an EM signal EM in response to the shift clock and the start pulse received from the timing controller 130 and sequentially shifts the EM signal EM according to the shift clock. For a model with a narrow bezel or no bezel, switch elements included in the first and second gate driving units 121 and 122 can be disposed in the pixel array AA in a distributed manner.

The timing controller 130 receives digital video data DATA of the input image and a timing signal synchronized with the digital video data DATA from a host system. The timing signal includes a vertical synchronization signal Vsync, a horizontal synchronization signal Hsync, a clock CLK, a data enable signal DE (see FIG. 6), etc. Since a vertical period and a horizontal period can be seen through a method of counting the data enable signal DE, the vertical synchronization signal Vsync and the horizontal synchronization signal Hsync will be omitted. The data enable signal DE has one horizontal period 1H.

The host system can be one of a television (TV) system, a set-top box, a navigation system, a personal computer (PC), a home theater system, and a mobile device system. The host system can scale image data of content to be displayed on first and second screens 42 and 44 and can transmit the image data to the timing controller 130.

The timing controller 130 can multiply an input frame frequency by i (here, i is an integer greater than zero) to control the operation timing of the display panel driving unit using a frame frequency equal to the input frame frequency×i Hz. The input frame frequency is 60 Hz for National Television Standards Committee (NTSC) and 50 Hz for Phase-Alternating Line (PAL). The timing controller 130 can lower the frame frequency to a frequency ranging between 1 Hz and 30 Hz in order to lower the refresh rate of the pixels in the low-speed driving mode.

The timing controller 130 can generate a data timing control signal for controlling the operation timing of the data driving unit 110, MUX signals MUX1 and MUX2 for controlling the operation timing of the demultiplexer array 112, and a gate timing control signal for controlling the operation timing of the gate driving unit 120 on the basis of timing signals Vsync, Hsync, and DE received from the host system.

The gate-on voltages VGL and VEL and the gate-off voltages VGH and VEH can be generated by converting the voltage level of the gate timing control signal output from the timing controller 130 through a level shifter and can be supplied to the gate driving unit 120. The level shifter converts the low level voltage of the gate timing control signal into the gate low voltage VGL and converts the high level voltage of the gate timing control signal into the gate high voltage VGH. The gate timing signal includes a start pulse and a shift clock.

The pixel circuit of the present disclosure can include an internal compensation circuit configured to sense the threshold voltage Vth of the driving element DT and compensate the threshold voltage Vth for the data voltage Vdata.

Figure 7:
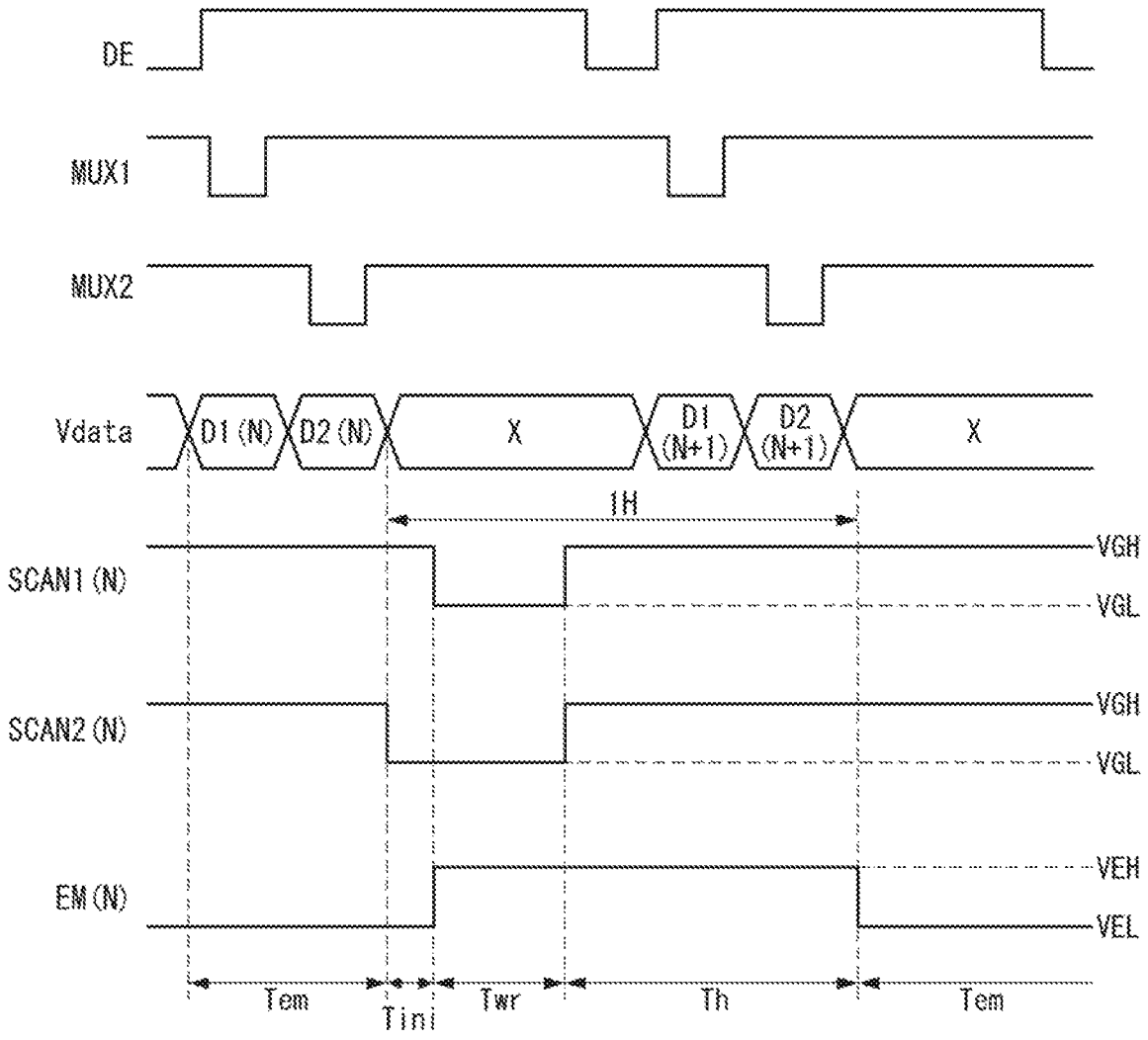
FIG. 7 is a waveform diagram showing an example of an operation of the pixel circuit and the demultiplexer shown in FIG. 6.

FIG. 6 is a circuit diagram showing the switch elements of the demultiplexer 112. FIG. 7 is a waveform diagram showing operation of the pixel circuit and the demultiplexer shown in FIG. 6. In FIG. 7, the previous data voltage Vdata can be maintained or a predetermined pre-charge voltage can be applied from the data driving unit 110 during a period "X." Also, channels CH1 and CH2 are separated from the demultiplexer 112 or the data lines 102 during a period X, and the data driving unit 110 can maintain high impedance.

Referring to FIGS. 6 and 7, the demultiplexer array 112 includes a first demultiplexer 21 configured to time-divisionally distribute a data voltage Vdata output through a first channel CH1 of the data driving unit 110 into the first and second data lines 1021 and 1022 using the switch elements M1 and M2 and a second demultiplexer 22 configured to time-divisionally distribute a data voltage Vdata output through a second channel (CH2) of the data driving unit 110 into the third and fourth data lines 1023 and 1024 using the switch elements M1 and M2.

During one horizontal period 1H in which data is written to pixels of one pixel line, the pixels can be driven differently in different periods such as an initialization period Tini, a data writing period Twr, and a holding period Th.

The pixels can emit light during an emission period Tem. The emission period Tem corresponds to most of one frame period except for one horizontal period 1H. The holding period Th can be added between the data writing period Twr and the emission period Tem.

In order to precisely express low-grayscale luminance, the EM signal EM(N) can swing between the gate-on voltage VEL and the gate-off voltage VEH at a predetermined duty ratio during the emission period Tem.

The operations of the demultiplexer 112 and the pixel circuits 1011 to 1014 will be described step by step. During the emission period Tem, data voltages D1(N) and D2(N) can be supplied to the pixel circuits 1011 to 1014 of an $N^{th}$ pixel line. A first MUX signal MUX1 is synchronized with the first data voltage D1(N). A second MUX signal MUX2 is synchronized with the second data voltage D2(N).

The first switch element M1 is turned on in response to the gate-on voltage VGL of the first MUX signal MUX1. In this case, the output buffer AMP of the first channel CH1 is connected to the first data line 1021 through the first switch element M1. At the same time, the output buffer AMP of the second channel CH2 is connected to the third data line 1023 through the first switch element M1. Accordingly, the capacitor 51 of the first data line 1021 is charged with the first data voltage D1(N), and the capacitor 53 of the third data line 1023 is charged with a third data voltage.

Subsequently, the second switch element M2 is turned on in response to the gate-on voltage VGL of the second MUX signal MUX2. In this case, the output buffer AMP of the first channel CH1 is connected to the second data line 1022 through the second switch element M2. At the same time, the output buffer AMP of the second channel CH2 is connected to the fourth data line 1024 through the second switch element M2. Accordingly, the capacitor 52 of the second data line 1022 is charged with the second data voltage D2(N), and the capacitor 54 of the fourth data line 1024 is charged with a fourth data voltage.

One horizontal period of the sub-pixels includes at least the initialization period Tini, the data writing period Twr, and the emission period Tem. One horizontal period of the sub-pixels can further include the holding period Th. During the initialization period Tini, the first and second electrodes of the capacitor Cst and the anode of the light-emitting element EL are initialized. During the data writing period Twr, the data voltage Vdata is supplied to the first electrode of the capacitor Cst, and VDD−Vth (the pixel driving voltage VDD minus the threshold voltage Vth of the driving element DT) is applied to the second electrode of the capacitor Cst. During the emission period Tem, the gate-on voltage VGL or VEL of the gate signal or the low-potential power supply voltage VSS applied to the cathode of the light-emitting element EL is applied to the first electrode of the capacitor Cst, and current flows through the light-emitting element EL. The internal compensation method will be described in detail in conjunction with FIGS. 9A to 13B.

Figure 10A:
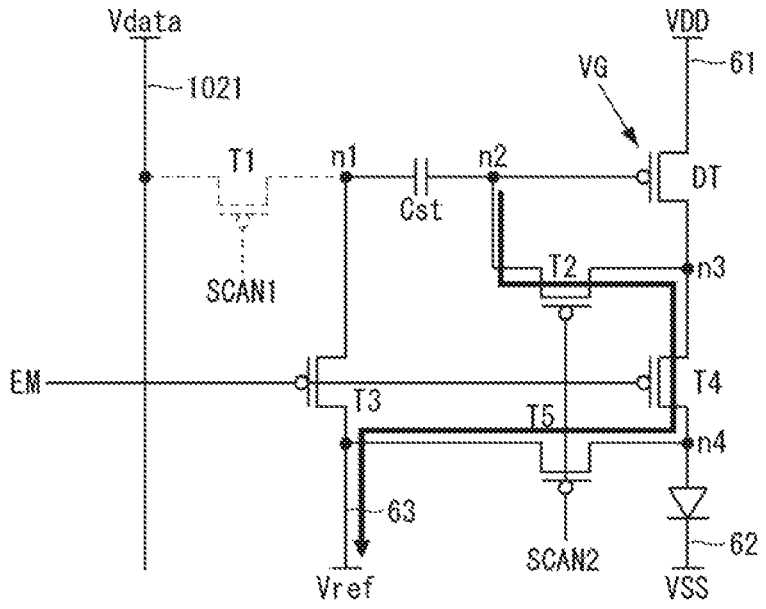
FIG. 10A is a circuit diagram showing an example of an operation of the pixel circuit during the initialization period.
Figure 10B:
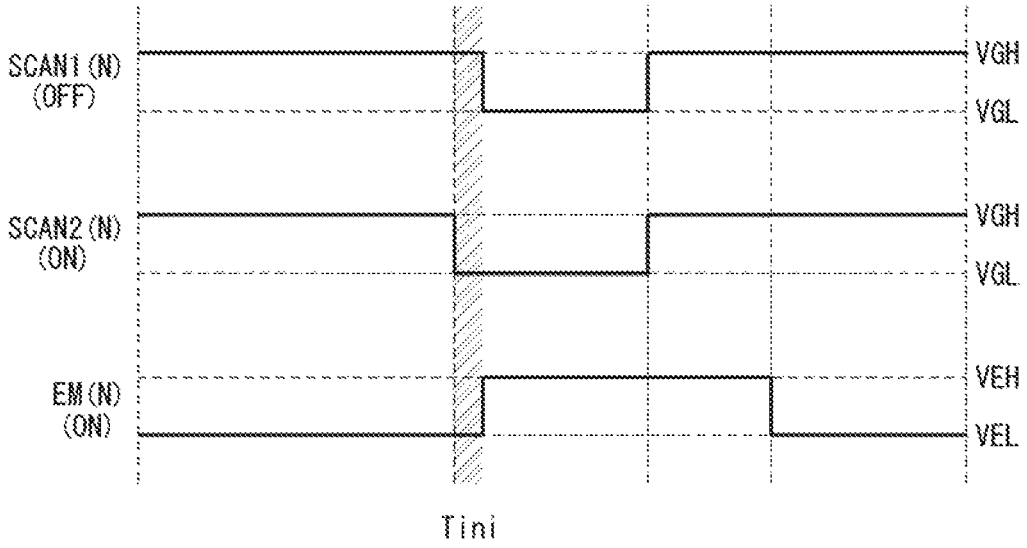
FIG. 10B is a waveform diagram showing an example of the driving signal of the pixel circuit during the initialization period.

During the initialization period Tini, the second scan signal SCAN2(N) is inverted into the gate-on voltage VGL. In this case, as shown in FIGS. 10A and 10B, main nodes of the pixel circuit can be initialized to the reference voltage Vref.

Figure 11A:
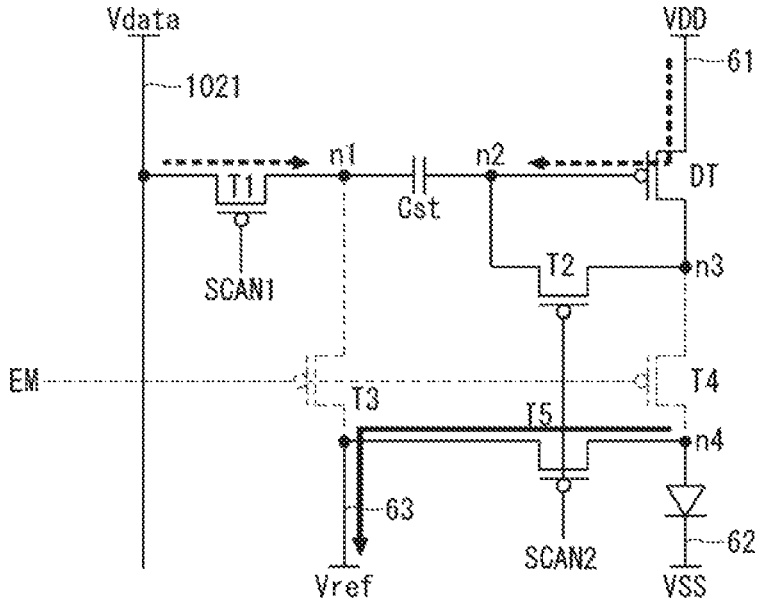
FIG. 11A is a circuit diagram showing an example of an operation of the pixel circuit during a data writing period.
Figure 11B:
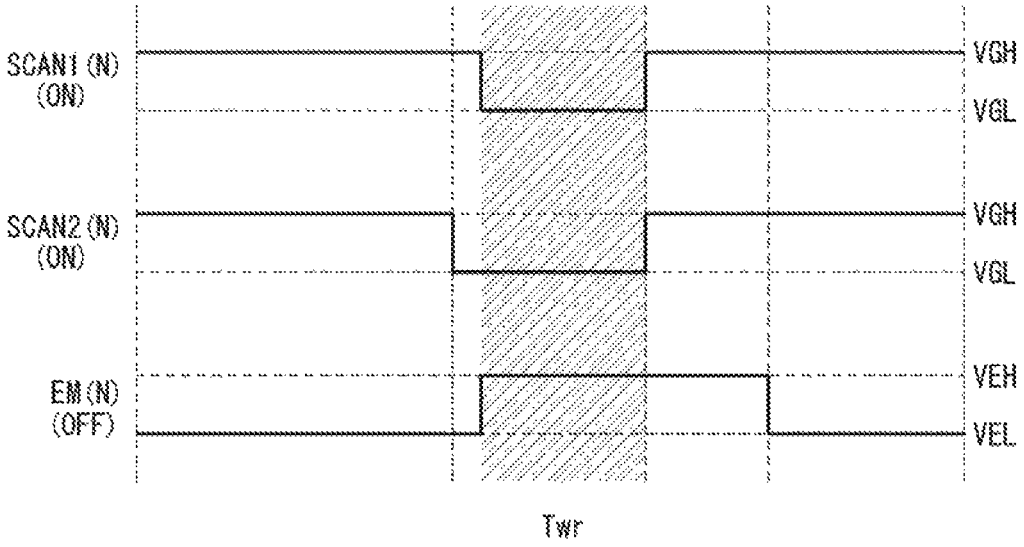
FIG. 11B is a waveform diagram showing an example of the driving signal of the pixel circuit during the data writing period.

During the data writing period Twr, the first scan signal SCAN1(N) is inverted into the gate-on voltage VGL. In this case, as shown in FIGS. 11A and 11B, the data voltage Vdata is applied to one electrode of the capacitor Cst, and VDD minus Vth is applied to the other electrode of the capacitor Cst. During the data writing period Twr, the driving element DT is operated as a diode by a second switch element T2 which is turned on. During the data writing period Twr, the voltage of a second node n2, that is, the gate voltage of the driving element DT, is increased by VDD minus Vth.

During the holding period Th, the first and second scan signals SCAN1(N) and SCAN2(N) are inverted into the gate-off voltage VGH.

The EM signal EM(N) can be generated as the pulse of the gate-off voltage VEH to prevent the light emission of the light-emitting element EL during the data writing period Twr and the holding period Th. During the emission period Tem, the EM signal EM(N) can be maintained at the gate-on voltage VEL or can be generated as an alternating current voltage transitioned between the gate-on voltage VEL and the gate-off voltage VEH at a predetermined duty ratio.

During the emission period Tem, a current flows through the light-emitting element EL using switch elements which are turned on according to the gate-on voltage VEL of the EM signal EM(N). In this case, the light-emitting elements EL of the pixel circuits 1011 to 1014 emit light.

FIG. 8 is a detailed circuit diagram showing an example of the pixel circuit. The demultiplexer 112 can be omitted from FIG. 8. In this case, the output buffer AMP is directly connected to the data lines 1021 and 1022 at each of the channels of the data driving unit 110.

Referring to FIG. 8, the pixel circuit includes a light-emitting element EL, multiple transistors T1 to T5 and DT, a capacitor Cst, etc.

The light-emitting element EL can be implemented as an OLED. The OLED includes an organic compound layer formed between an anode and a cathode. The organic compound layer can include a hole injection layer HIL, a hole transport layer HTL, an emission layer EML, an electron transport layer ETL, an electron injection layer EIL, and the like, but the present disclosure is not limited thereto. The anode of the light-emitting element EL is connected to the fourth and fifth switch elements T4 and T5 through a fourth node n4. The cathode of the light-emitting element EL is connected to a second power supply line 62 through which VSS is applied. The driving element DT supplies current to the light-emitting element EL according to the gate-source voltage Vsg to drive the light-emitting element EL. The light-emitting element EL emits light using current adjusted by the driving element DT according to the data voltage Vdata. The electric current path of the light-emitting element EL is switched by the fourth switch element T4.

The capacitor Cst is connected between a first node n1 and a second node n2. The first node n1 is connected to a second electrode of the first switch element T1, a first electrode of the third switch element T3, and a first electrode of the capacitor Cst. The second node n2 is connected to a second electrode of the capacitor Cst, a gate of the driving element DT, and a first electrode of the second switch element T2. The capacitor Cst is charged with the data voltage for which the threshold voltage Vth of the driving element DT is compensated. Accordingly, since the threshold voltage Vth of the driving element DT is compensated for the data voltage Vdata for each sub-pixel 101, threshold voltage variations of the driving element DT can be compensated for in the sub-pixels 101.

The first switch element T1 is turned on in response to the gate-on voltage VGL of the first scan signal SCAN1 to supply the data voltage Vdata to the first node n1. The first switch element T1 includes a gate connected to the first gate line 31, a first electrode connected to the data lines 1021 and 1022, and a second electrode connected to the first node n1. The first scan signal SCAN1 can be applied to the sub-pixels 101 through the first gate line 31. The first scan signal SCAN1 is generated as a pulse of the gate-on voltage VGL. The pulse of the first scan signal SCAN1 defines the data writing period Twr.

The second switch element T2 is turned on in response to the gate-on voltage VGL of the second scan signal SCAN2 to connect the gate of the driving element DT to the second electrode. The driving element DT is operated as a diode by the second switch element T2 turned on during the data writing period Twr. The second switch element T2 includes a gate connected to the second gate line 32, a first electrode connected to the second node n2, and a second electrode connected to the third node n3. As shown in FIG. 7, a pulse of the second scan signal SCAN2 is inverted into the gate-on voltage VGL before the pulse of the first scan signal SCAN1 to define the initialization period Tini and then is inverted to the gate-off voltage VGH simultaneously with the pulse of the first scan signal SCAN1.

The third switch element T3 is turned on in response to the gate-on voltage VEL of the EM signal EM to connect the first node n1 to a third power supply line 63 during the initialization period Tini and the emission period Tem. Vref is supplied to the sub-pixels 101 through the third power supply line 63 in common. The anode voltage of the light-emitting element EL, the driving element DT, and the capacitor Cst are initialized during the initialization period Tini during which the third switch element T3 is turned on. The third switch element T3 includes a gate connected to the third gate line 33, a first electrode connected to the first node n1, and a second electrode connected to the third power supply line 63.

A pulse of the EM signal EM can be generated to have the gate-off voltage VEH to suppress the light emission of the light-emitting element EL during the data writing period Twr and the holding period Th. The pulse of the EM signal EM can be inverted into the gate-off voltage VEH when the first scan signal SCAN1 is inverted into the gate-on voltage and can be inverted into the gate-on voltage VEL after the first scan signal SCAN1 and the second scan signal SCAN2 are inverted into the gate-off voltage.

The fourth switch element T4 is turned on in response to the gate-on voltage VEL of the EM signal EM to connect the third node n3 to the fourth node n4 during the initialization period Tini and the emission period Tem. The fourth switch element T4 has a gate connected to the third gate line 33. The fourth switch element T4 has a first electrode connected to the third node n3 and a second electrode connected to the fourth node n4.

The fifth switch element T5 is connected between the second gate line 32 and the fourth node n4. The fifth switch element T5 is turned on in response to the gate-on voltage VGL of the second scan signal SCAN2 to connect the third power supply line 63 to the fourth node n4 and discharge the voltage of the fourth node n4 to Vref during the initialization period Tini and the data writing period Twr. The fifth switch element T5 includes a gate connected to the second gate line 32, a first electrode connected to the third power supply line 63, and a second electrode connected to the fourth node n4.

The driving element DT drives the light-emitting element EL by adjusting current flowing through the light-emitting element EL according to the gate-source voltage Vsg. The driving element DT includes a gate connected to the second node n2, a first electrode connected to the first power supply line 61, and a second electrode connected to the third node n3. VDD is supplied to the sub-pixels through the first power supply line 61.

Figure 9A:
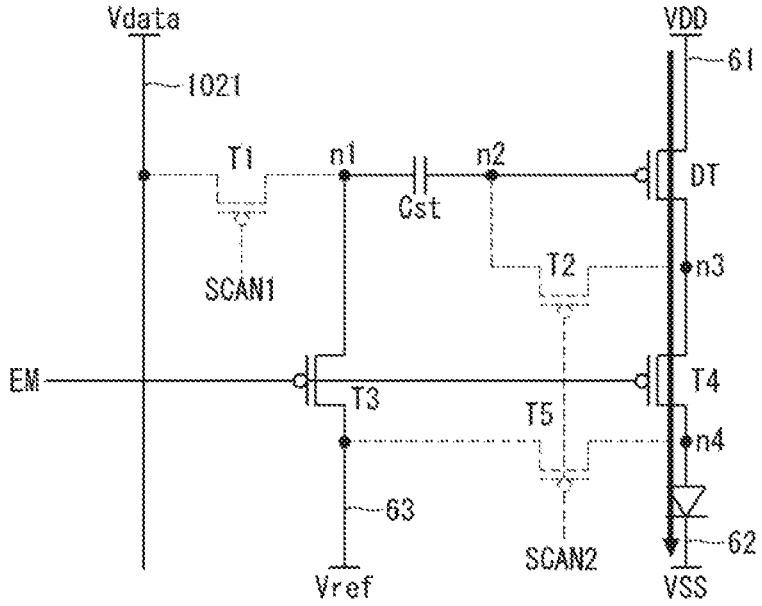
FIG. 9A is a circuit diagram showing an example of an operation of the pixel circuit during an emission period before an initialization period.
Figure 9B:
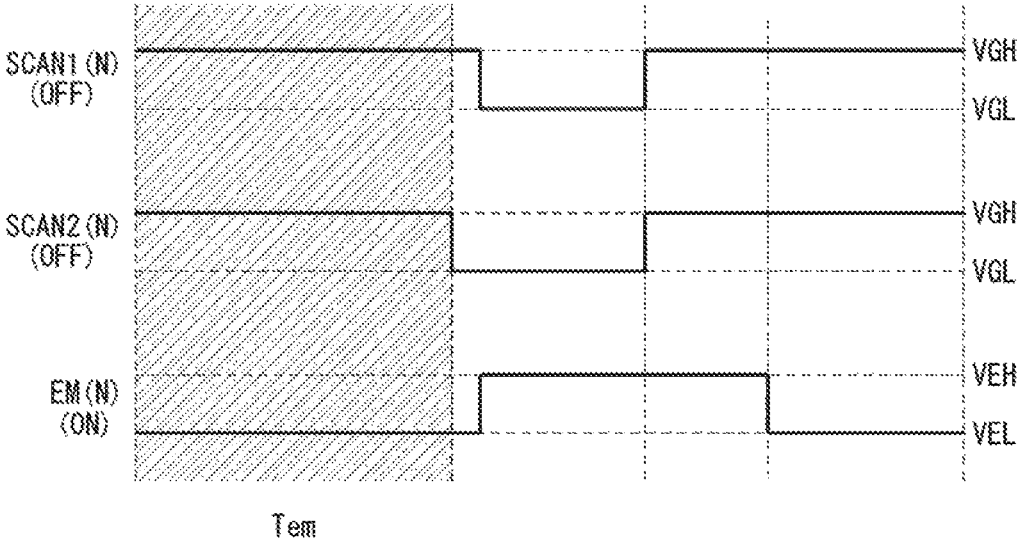
FIG. 9B is a waveform diagram showing an example of a driving signal of the pixel circuit during the emission period before the initialization period.

FIG. 9A is a circuit diagram showing operation of the pixel circuit during the emission period before the initialization period. FIG. 9B is a waveform diagram showing the driving signal of the pixel circuit during the emission period before the initialization period.

Referring to FIGS. 9A and 9B, the EM signal EM is generated as the gate-on voltage VEL during at least a portion of the emission period Tem. The first electrode voltage of the capacitor Cst is Vref during the emission period Tem. The driving element DT supplies current to the light-emitting element EL according to the gate-source voltage Vsg during the emission period Tem. During the emission period Tem, a current flows from VDD to VSS as indicated by an arrow and causes the light-emitting element EL to emit light. Since the current flowing through the light-emitting element EL is not affected by the threshold voltage Vth of the driving element DT and the IR drop of VDD as expressed in Equation 1, the threshold voltage of the driving element DT and the IR drop of the VDD are compensated for the current.

$$\text{Ioled}=K(Vsg-|Vth|)^2=K(VDD-\{VDD-|Vth|-(V\text{data}-V\text{ref})\}-|Vth|)^2=K(V\text{data}-V\text{ref})^2 \quad \text{[Equation 1]}$$

Here, K is a constant value determined by the mobility, channel ratio W/L, parasitic capacitance, and the like of the driving element DT.

FIG. 10A is a circuit diagram showing operation of the pixel circuit during the initialization period Tini. FIG. 10B is a waveform diagram showing the driving signal of the pixel circuit during the initialization period Tini.

Referring to FIGS. 10A and 10B, the voltages of the EM signal EM and the second scan signal SCAN 2 are equal to the gate-on voltages VGL and VEL during the initialization period Tini. In this case, the second, fourth, and fifth switch elements T2, T4, and T5 are turned on so that the capacitor Cst, the gate of the driving element DT, and the anode of the light-emitting element (OLED) are initialized to Vref.

FIG. 11A is a circuit diagram showing operation of the pixel circuit during the data writing period Twr. FIG. 11B is a waveform diagram showing the driving signal of the pixel circuit during the data writing period Twr.

Referring to FIGS. 11A and 11B, the voltages of the first scan signal SCAN1 and the second scan signal SCAN2 are equal to the gate-on voltage VGL during the data writing period Twr. In this case, the first, second, and fifth switch elements T1, T2, and T5 are turned on. During the data writing period Twr, the data voltage Vdata received from the data line 1021 is applied to the first electrode of the capacitor Cst. The capacitor Cst is charged with VDD−Vth, which is a voltage applied through the gate and drain (second electrode) of the driving element DT connected by a diode. Vth indicates the threshold voltage of the driving element DT. Accordingly, the gate voltage of the driving element DT is equal to VDD−Vth during the data writing period Twr.

Figure 12A:
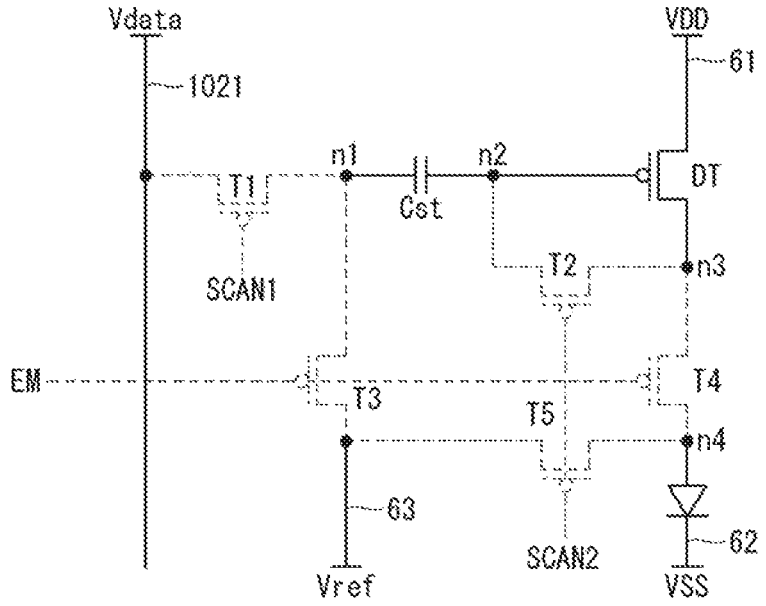
FIG. 12A is a circuit diagram showing an example of an operation of the pixel circuit during a holding period.
Figure 12B:
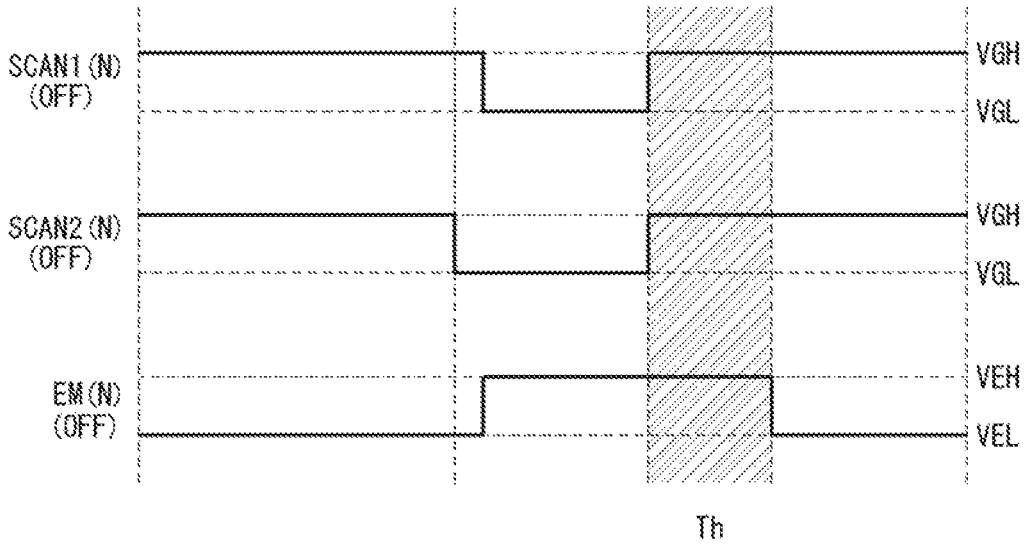
FIG. 12B is a waveform diagram showing an example of the driving signal of the pixel circuit during the holding period.

FIG. 12A is a circuit diagram showing operation of the pixel circuit during the holding period Th. FIG. 12B is a waveform diagram showing the driving signal of the pixel circuit during the holding period Th.

Referring to FIGS. 12A and 12B, the voltages of the EM signal EM and the first and second scan signal SCAN1 and SCAN 2 are equal to the gate-off voltages VGH and VEH. During the holding period Th, the first to fifth switch elements T1 to T5 are turned off. The voltage of the capacitor Cst is maintained during the holding period Th.

Figure 13A:
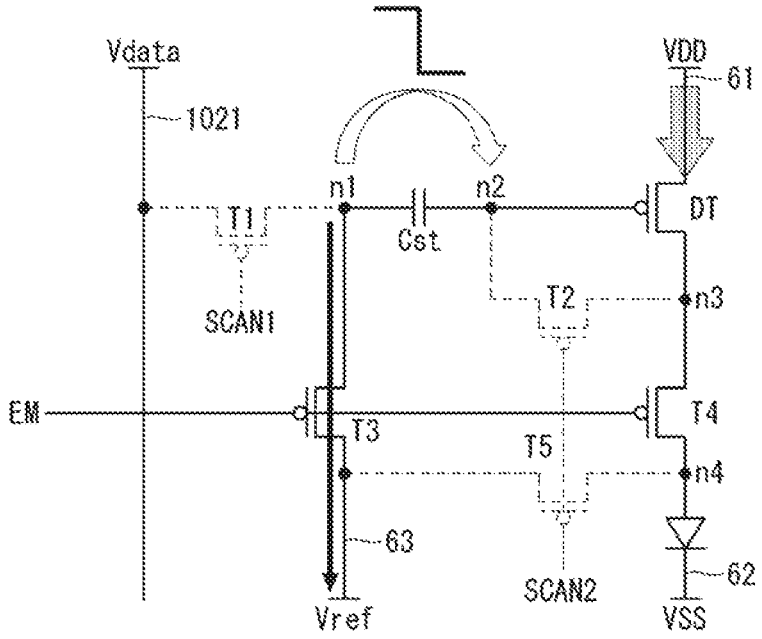
FIG. 13A is a circuit diagram showing an example of an operation of the pixel circuit during an emission period after the holding period.
Figure 13B:
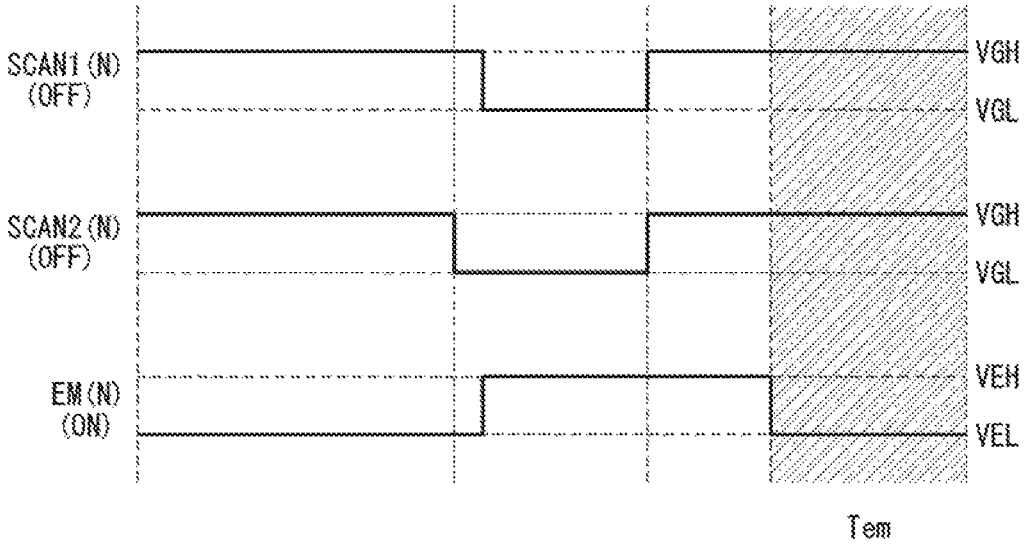
FIG. 13B is a waveform diagram showing an example of the driving signal of the pixel circuit during the emission period after the holding period.

FIG. 13A is a circuit diagram showing operation of the pixel circuit during the emission period Tem after the holding period Th. FIG. 13B is a waveform diagram showing the driving signal of the pixel circuit during the emission period Tem after the holding period Th.

Referring to FIGS. 13A and 13B, the EM signal EM is inverted into the gate-on voltage VEL during the emission period Tem.

The second electrode of the capacitor Cst is changed according to the voltage of the first electrode by the capacitor coupling with the first electrode. When the voltage of the first electrode of the capacitor Cst is changed from Vdata to Vref during the emission period Tem, the voltage of the second electrode of the capacitor Cst is decreased by the data voltage Vdata. Accordingly, the gate voltage Vg of the driving element DT is changed to VDD−Vth−(Vdata−Vref) during the emission period Tem.

During the emission period Tem, the current IoLED shown in Equation 1 is supplied to the light-emitting element EL through the fourth switch element T4 and the driving element DT. The voltage of the first electrode of the capacitor Cst is equal to VSS during the emission period Tem. During the emission period Tem, a current flows from VDD to VSS and causes the light-emitting element EL to emit light. Since the current flowing through the light-emitting element EL is not affected by the threshold voltage Vth of the driving element DT and the IR drop of VDD as expressed in Equation 1, the threshold voltage of the driving element DT and the IR drop of the VDD are compensated for the current.

Figure 14:
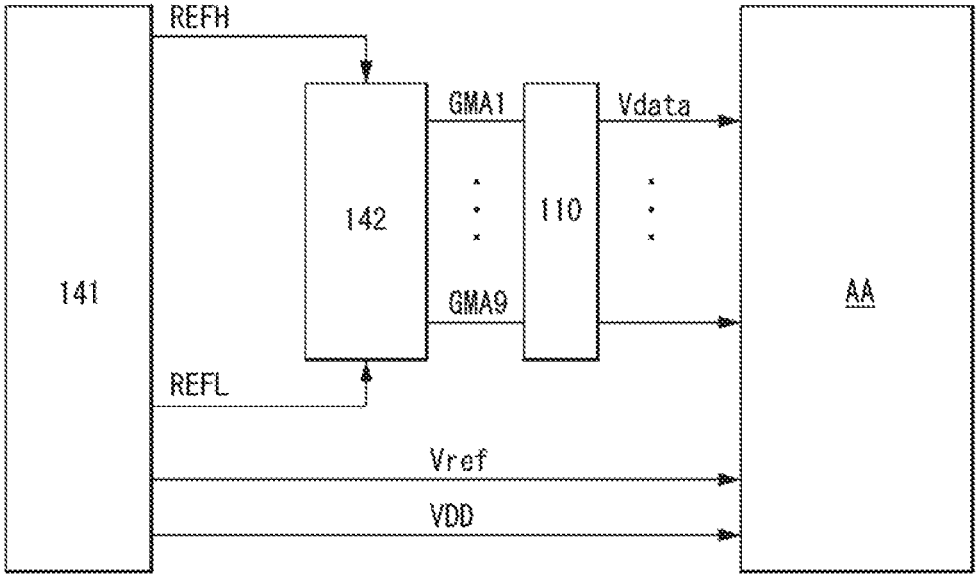
FIG. 14 is a diagram showing an example of a direct current (DC) power generation unit.

FIG. 14 is a diagram showing an example of a DC power generation unit.

Referring to FIG. 14, the power supply unit 140 includes a DC power generation unit for generating DC power necessary to drive the pixel array AA.

The DC power generation unit includes a power generation unit 141 and a gamma reference voltage generation unit 142.

The power generation unit 141 outputs DC voltages such as VDD, Vref, and Vss and first and second input reference voltages REFH and REFL using a DC-DC converter. The second input reference voltage REFL is lower than the first input reference voltage REFH. When the driving element DT is a p-channel transistor, the maximum voltage of the data voltage Vdata can be a lowest grayscale voltage, and the minimum voltage of the data voltage Vdata can be a highest grayscale voltage. The lowest grayscale level can be considered synonymous with a grayscale level of zero (0) or black. The highest grayscale level can be considered synonymous with a grayscale level of 256 or white in 8-bit pixel data.

The gamma reference voltage generation unit 142 receives the first and second input reference voltages REFH and REFL. The gamma reference voltage generation unit 142 divides the first input reference voltage REFH using a voltage divider circuit connected between a first input reference voltage node and a second input reference voltage node. The gamma reference voltage generation unit 142 outputs gamma reference voltages GMA1 to GMA 9 of each of "R" (red) data to be supplied to "R" sub-pixels, "G" (green) data to be supplied to "G" sub-pixels, and "B" (blue) data to be supplied to "B" sub-pixels. The gamma reference voltages GMA1 to GMA9 are split voltages ranging between the first input reference gamma reference voltage REFH and the second input reference voltage REFL and have different voltage levels. The gamma reference voltage generation unit 142 can be implemented as a programmable gamma IC for adjusting the voltage levels of the gamma reference voltages GMA1 to GMA9 to optimal values for each of "R" data, "G" data, and "B" data using a DAC and register setting values.

In the DC power generation unit as shown in FIG. 14, ten output voltages of the power generation unit 141 can change depending on the load variation of the pixel array. As an example, VDD can rise as shown in FIG. 16 when a high current flows through the pixel array AA.

Figure 15:
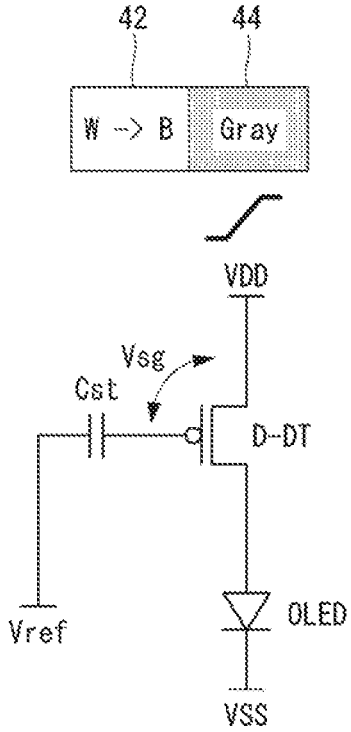
FIGS. 15 and 16 are diagrams showing a cause of a luminance variation appearing when a scene change occurs in one of two images displayed on a screen.
Figure 16:
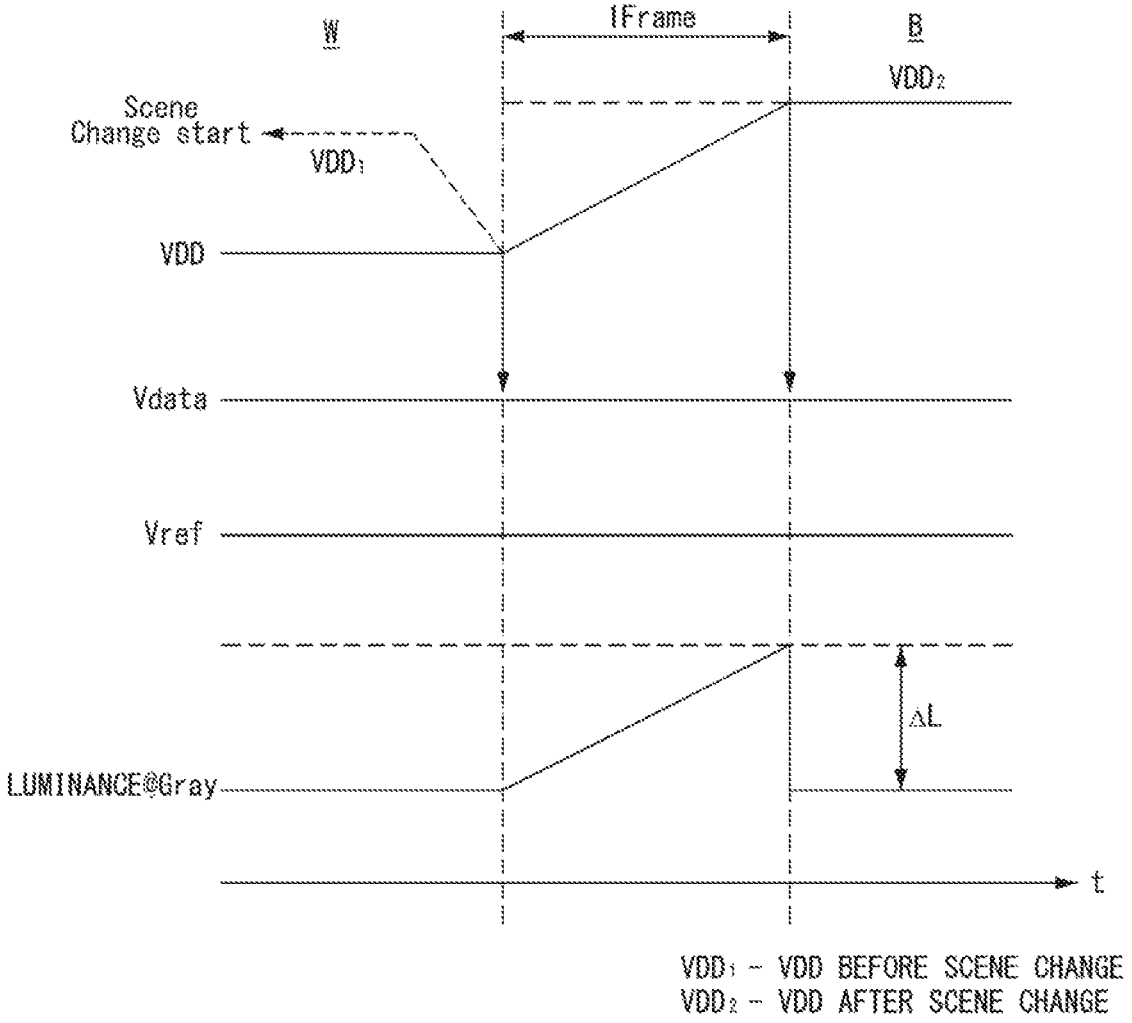

FIGS. 15 and 16 are diagrams showing a cause of a luminance variation appearing when a scene change occurs in one of two images displayed on a screen. In FIG. 15, Vsg indicates the gate-source voltage of the driving element DT. In FIG. 16, "luminance@Gray" is luminance of a middle grayscale level of the second screen 44.

Referring to FIGS. 15 and 16, in order to make a situation similar to a scene change of one of the first and second screens 42 and 44, the data voltage Vdata of a white grayscale level W is applied to all pixels of the first screen 42, and then the data voltage Vdata of a black grayscale level B is applied to all pixels of the first screen 42 in the next frame. In this case, the data voltage Vdata of a middle grayscale level, for example, a grayscale level of 127, is applied to all the pixels of the second screen 44.

When the data voltage Vdata applied to the pixels of the first screen 42 is increased from a white grayscale voltage to a black grayscale voltage, VDD can rise from $VDD_1$ to $VDD_2$ due to the rise of the gate voltage through the gate-source parasitic capacitance of the driving element DT. Since VDD is applied to the pixels of the first and second screens 42 and 44 in common, the luminance is increased in the pixels of the second screen 44. Accordingly, a flicker in which the second screen 44 brightens temporarily can appear.

When DC power is generated in the DC power generation unit as shown in FIG. 14, a change in VDD is reflected in the gate-source voltage Vsg of the driving element DT in a section where a scene change occurs ("1Frame" in FIG. 16) during the emission period Tem as expressed in Equation 2, and thus a luminance variation can occur.

$$Vsg = VDD - \{(VDD_1 - Vth) - (\text{DATA} - V_{set})\} = Vth - (\text{DATA} - V_{ref}) + \Delta VDD \quad \text{[Equation 2]}$$

Here, $VDD - VDD_1 = \Delta VDD$.

$VDD_1$ is VDD before the scene change, and $VDD_2$ is VDD after the scene change. ΔVDD is a variation of VDD.

Equation 3 represents the gate-source voltage Vsg during the emission period Tem after the scene change. As expressed in Equation 3, the influence of VDD is removed from the gate-source voltage Vsg of the driving element DT after the scene change so that the luminance before the scene change is maintained on the first screen 42.

$$Vsg=VDD_2-\{(VDD_2-Vth)-(DATA-V_{ref})\}=Vth-(DATA-V_{ref}) \quad \text{[Equation 3]}$$

Figure 17:
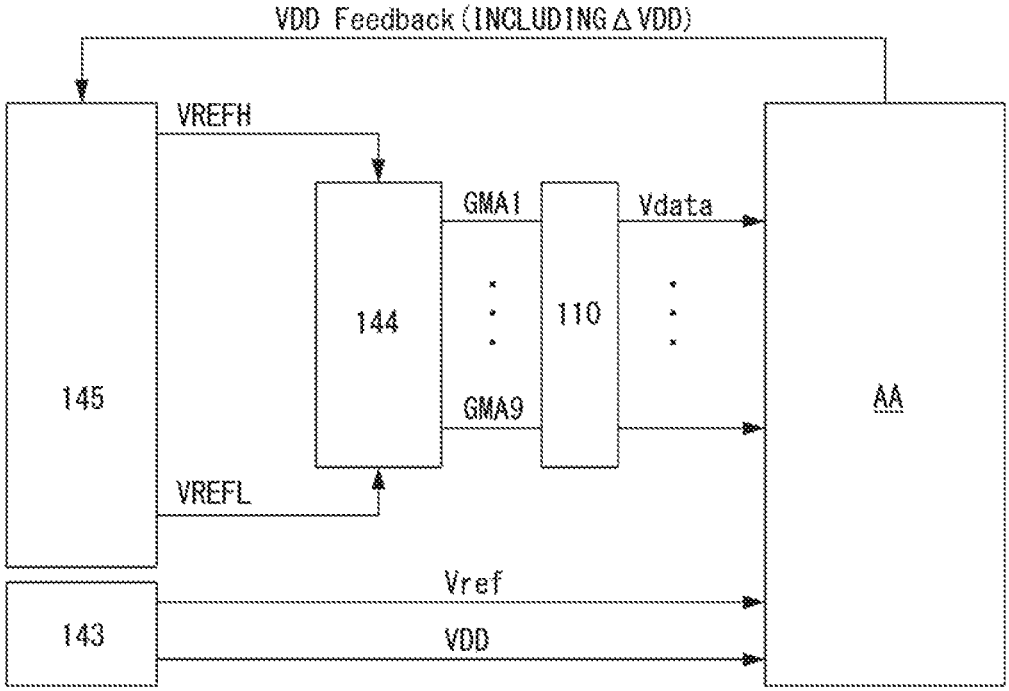
FIG. 17 is a diagram showing an example of a feedback compensation power generation unit.
Figure 18:
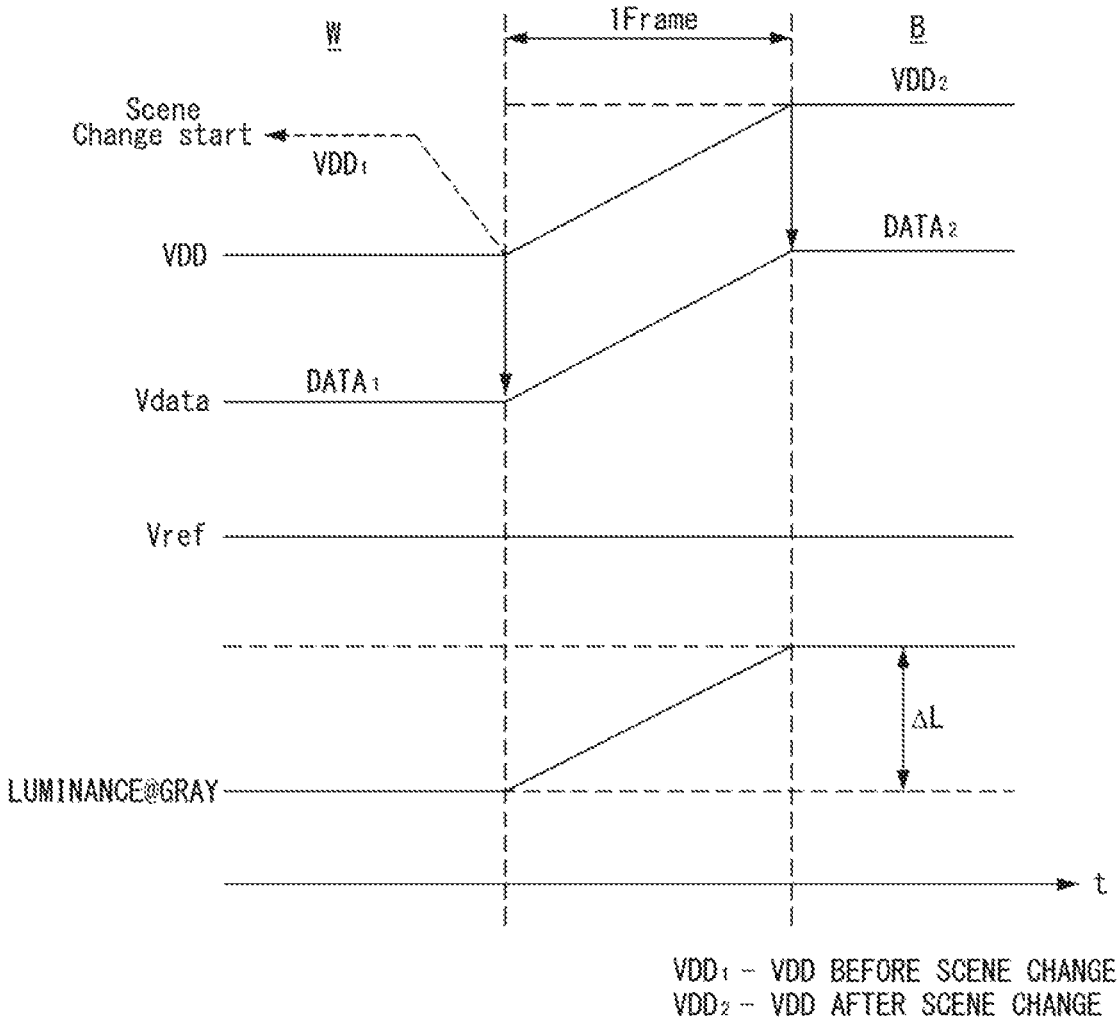
FIG. 18 is a waveform diagram showing a cause of a luminance variation occurring when the feedback compensation power generation unit shown in FIG. 17 is used.

FIG. 17 is a diagram showing an example of a feedback compensation power generation unit. FIG. 18 is a waveform diagram showing a cause of a luminance variation occurring when the feedback compensation power generation unit shown in FIG. 17 is used.

Referring to FIGS. 17 and 18, the power supply unit 140 includes a feedback compensation power generation unit for changing an output voltage according to a VDD variation ΔVDD received from the pixel array AA as a feedback input.

The feedback compensation power generation unit includes a compensation power generation unit 145, a power generation unit 143, and a gamma reference voltage generation unit 144.

The compensation power generation unit 145 outputs first and second input reference voltages VREFH and VREFL using a non-inverting amplifier. The compensation power generation unit 145 receives, as a feedback input, VDD applied to the pixel array AA through the first power supply line VDD or the VDD feedback line 61*f* connected to the pixels of the pixel array AA of the display panel 100 and changes compensation voltages VREFH and VREFL by the VDD variation ΔVDD. When VDD increases, the compensation power generation unit 145 increases the input reference voltages VREFH and VREFL and thus increases the data voltage Vdata output from the data driving unit 110 by the VDD variation ΔVDD. When VDD decreases, the compensation power generation unit 145 decreases the first and second input reference voltages VREFH and VREFL and thus decreases the data voltage Vdata by the VDD variation ΔVDD.

The power generation unit 143 outputs DC voltages such as VDD, REFH, REFL, Vref, and VSS.

The gamma reference voltage generation unit 142 receives the first and second input reference voltages VREFH and VREFL. The gamma reference voltage generation unit 142 outputs gamma reference voltages GMA1 to GMA 9 of each of "R" data, "G" data, and "B" data. The VDD variation ΔVDD is reflected in the first and second input reference voltages VREFH and VREFL, and thus the data voltage Vdata increases when the input reference voltages VREFH and VFEFL increase. The data voltage Vdata decreases when the input reference voltages VREFH and VREFL decrease. The gamma reference voltage generation unit 142 can be implemented as a programmable gamma IC.

When DC power is generated in the DC power generation unit as shown in FIG. 17, a change in VDD is reflected in the gate-source voltage Vsg of the driving element DT in a section where a scene change occurs ("1Frame" in FIG. 18) during the emission period Tem as expressed in Equation 4, and thus a luminance variation occurs.

$$Vsg=VDD-\{(VDD_1-Vth)-(DATA-V_{ref})\}=Vth-(DATA-V_{ref})+\Delta VDD \quad \text{[Equation 4]}$$

Here, $VDD-VDD_1=\Delta VDD$.

Equation 5 represents the gate-source voltage Vsg during the emission period Tem after the scene change. As expressed in Equation 5, the influence of VDD is removed from the gate-source voltage Vsg of the driving element DT after the scene change, but the luminance variation can occur due to the variation of the data voltage Vdata.

$$Vsg=VDD_2-\{(VDD_2-Vth)-(DATA_2-V_{ref})\}=Vth-(DATA_2-V_{ref})=Vth+(DATA_1-V_{ref})+\Delta VDD \quad \text{[Equation 5]}$$

Figure 19:
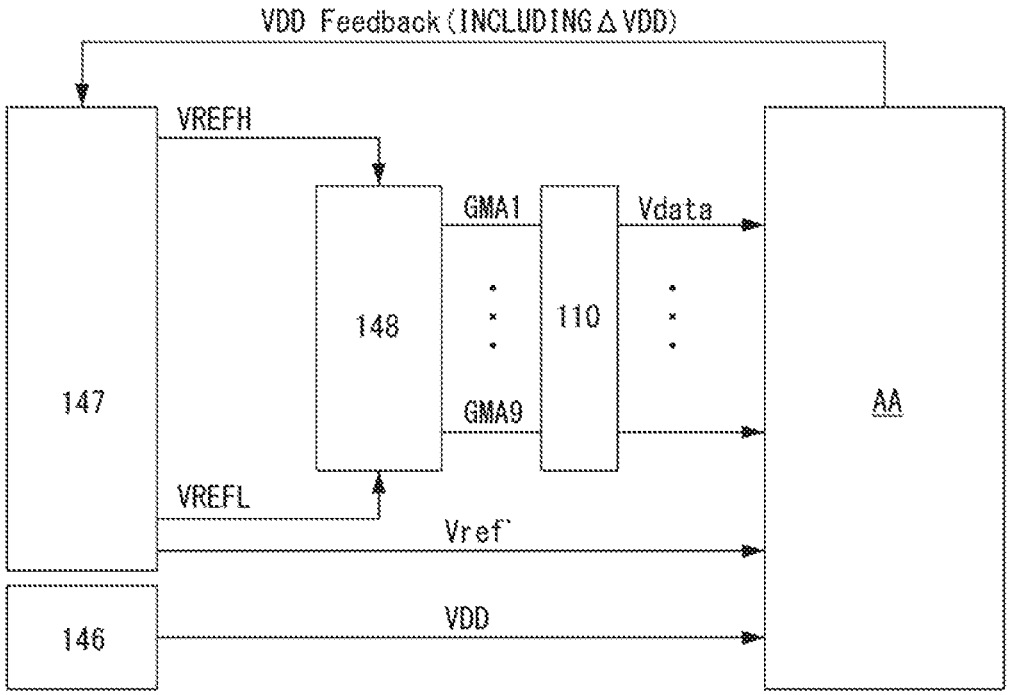
FIG. 19 is a diagram showing the feedback compensation power generation unit according to an embodiment of the present disclosure.
Figure 20:
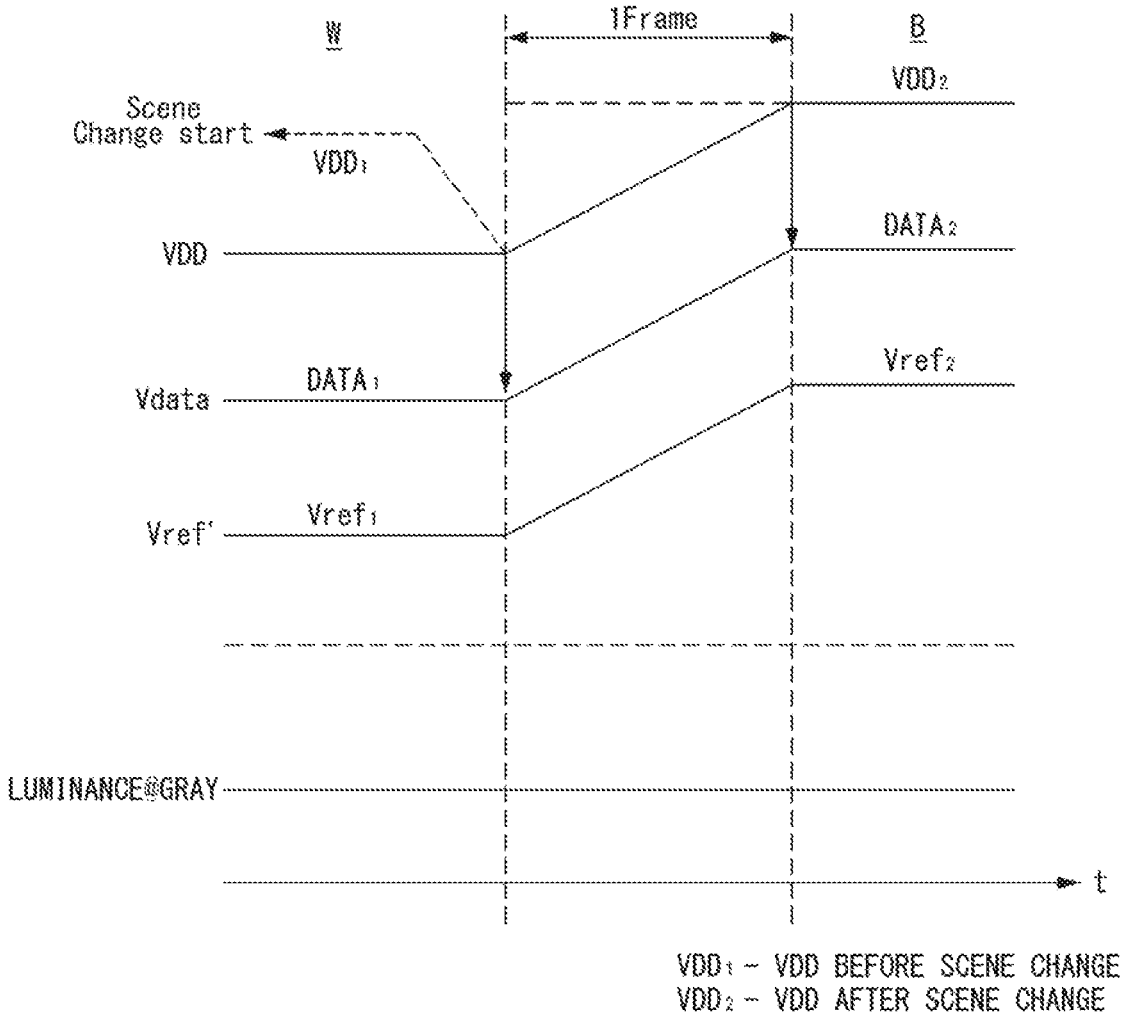
FIG. 20 is a waveform diagram showing a cause of a luminance variation occurring when the feedback compensation power generation unit shown in FIG. 19 is used.

FIG. 19 is a diagram showing the feedback compensation power generation unit according to an embodiment of the present disclosure. FIG. 20 is a waveform diagram showing a cause of a luminance variation occurring when the feedback compensation power generation unit shown in FIG. 19 is used.

Referring to FIGS. 19 and 20, the power supply unit 140 includes a feedback compensation power generation unit for changing an output voltage according to a VDD variation ΔVDD received from the pixel array AA as a feedback input.

The feedback compensation power generation unit includes a compensation power generation unit 147, a power generation unit 146, and a gamma reference voltage generation unit 148.

As shown in FIG. 19, the compensation power generation unit 147 outputs first and second input reference voltages VREFH and VREFL and a reference voltage Vref' using a non-inverting amplifier. The compensation power generation unit 147 receives, as a feedback input, VDD applied to the pixel array AA through the first power supply line 61 or the VDD feedback line 61*f* of the pixel array AA of the display panel 100 and changes the input reference voltages VREFH and VREFL and the reference voltage Vref' of the pixel circuit by the VDD variation ΔVDD.

As shown in FIG. 20, when VDD increases, the compensation power generation unit 147 increases the input reference voltages VREFH and VREFL and thus increases the data voltage Vdata output from the data driving unit 110 by the VDD variation ΔVDD. When VDD decreases, the compensation power generation unit 147 decreases the first and second input reference voltages VREFH and VREFL using the non-inverting amplifier and thus decreases the data voltage Vdata by the VDD variation ΔVDD.

When VDD increases, the compensation power generation unit 147 increases the reference voltage Vref' supplied to the pixel array AA by the VDD variation ΔVDD using the non-inverting amplifier, as shown in FIG. 20. When VDD decreases, the compensation power generation unit 145 decreases the reference voltage Vref' of the pixel circuit by the VDD variation ΔVDD using the non-inverting amplifier.

The power generation unit 146 outputs DC voltages such as VDD, REFH, REFL, Vref, and VSS.

As can be seen in FIG. 20, when the VDD variation ΔVDD occurs due to the scene change, the luminance is constantly maintained on the second screen 44 by adjusting the reference voltage Vref of the pixel array and the data voltage Vdata by the VDD variation ΔVDD. This can be easily understood from the gate-source voltage Vsg of the driving element DT expressed in Equations 6 and 7.

When DC power is generated in the DC power generation unit as shown in FIG. 19, the change in VDD is offset by the change in Vref in the section where a scene change occurs ("1Frame" in FIG. 20) during the emission period Tem as expressed in Equation 6, and thus the luminance (luminance@Gray) of the second screen 44 is maintained during, before, and after the scene change.

$$Vsg=VDD-\{(VDD_1-Vth)-(DATA_1-V_{ref2})\}=Vth-(DATA_1-V_{ref1}) \quad \text{[Equation 6]}$$

Here, $V_{ref2}=V_{ref1}+\Delta VDD$, and $VDD-VDD_1=\Delta VDD$.

Further, $V_{ref1}$ is Vref before the scene change, and $V_{ref2}$ is Vref after the scene change.

Equation 7 represents the gate-source voltage Vsg during the emission period Tem after the scene change. As expressed in Equation 7, the influence of VDD is removed from the gate-source voltage Vsg of the driving element DT after the scene change, and the luminance is maintained by offsetting the variation of Vref and the data voltage Vdata.

$$Vsg=VDD_2-\{(VDD_2-Vth)-(DATA_2-V_{ref2})\}=Vth-(DATA_1-V_{ref1}) \quad \text{[Equation 7]}$$

Figure 21:
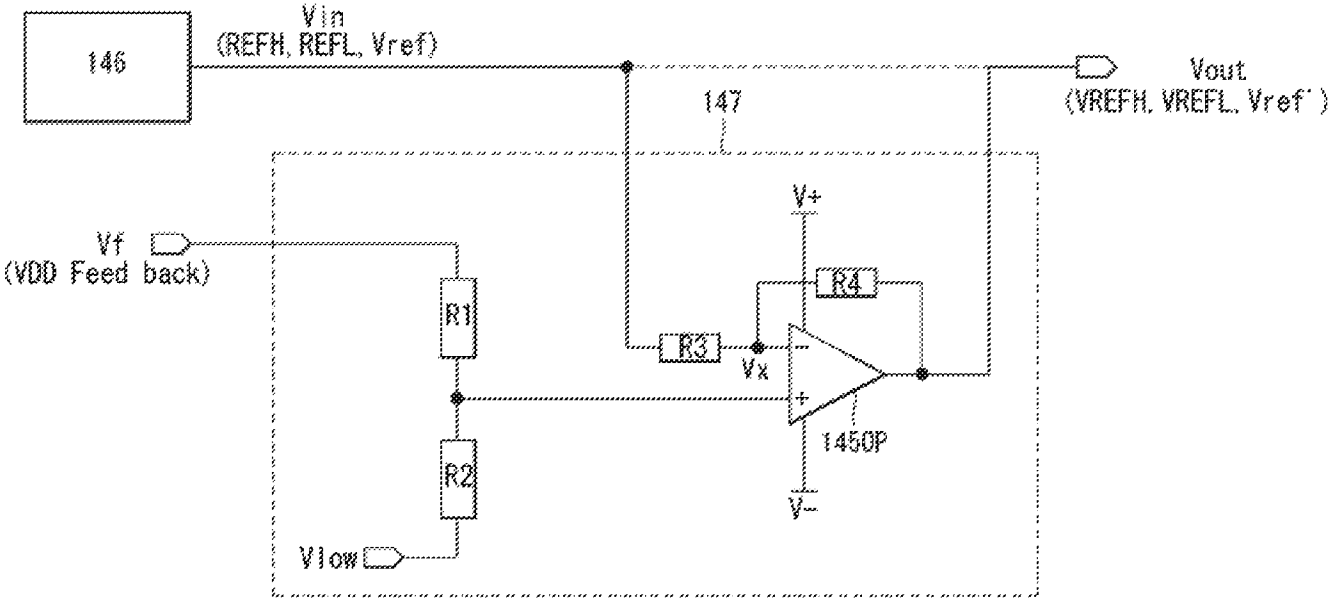
FIG. 21 is a diagram showing a non-inverting amplifier of a feedback compensation power generation unit.

FIG. 21 is a diagram showing a non-inverting amplifier of a feedback compensation power generation unit.

Referring to FIG. 21, the feedback compensation power generation unit includes a first non-inverting amplifier configured to receive REFH and the VDD feedback voltage Vf and change REFH according to the VDD variation, a second non-inverting amplifier configured to receive REFL and the VDD feedback voltage Vf and change REFL according to the VDD variation, and a third non-inverting amplifier configured to receive Vref and the VDD feedback voltage Vf and change Vref according to the VDD variation. The VDD feedback voltage Vf can be VDD supplied to the display panel 100 on the PCB.

Each of the non-inverting amplifiers includes a resistor R3 connected between an output terminal of the power generation unit 146 and an inverting input terminal (−) of an operational amplifier 1450P, a resistor R4 connected between an output terminal of the operational amplifier 1450P and the inverting input terminal (−) of the operational amplifier 1450P, and feedback voltage supply units R1 and R2 configured to supply the VDD feedback voltage Vf to a non-inverting input terminal (+) of the operational amplifier 1450P.

The power generation unit 146 outputs DC voltages Vin such as REFH, REFL, and Vref. The DC voltage Vin is supplied to the inverting input terminal (−) of the operational amplifier 1450P through the resistor R3. One of the VDD feedback line 61*f*, the first power supply line 61 of the display panel 100, and the VDD line on the PCB is connected to the feedback voltage supply units R1 and R2. The feedback voltage supply units R1 and R2 is a voltage divider circuit including resistors R1 and R2 connected in series between Vf and Vlow. The VDD feedback voltage Vf is VDD applied from one of the VDD line, the first power supply line 61 of the display panel 100, and the VDD feedback line 61*f*. The feedback voltage Vf is supplied to the non-inverting input terminal (+) of the operational amplifier 1450P through a node between the resistors R1 and R2.

The output voltage Vout and the non-inverting input voltage Vx of the operational amplifier 1450P are equal to Equation 8 and Equation 9, respectively.

$$Vin=\frac{R2}{R1+R2}Vf+\left(\frac{R2}{R1+R2}\right)Vlow \quad \text{[Equation 8]}$$

$$Vout=\left(1+\frac{R4}{R3}\right)Vx-\frac{R4}{R3}Vin \quad \text{[Equation 9]}$$

The gain of the non-inverting amplifier is a ratio of a variation of the output voltage Vo (=Vout) to a variation of the feedback voltage Vf and is expressed in Equation 10.

$$\text{Gain}=\frac{\Delta Vout}{\Delta Vf}=\left(\frac{R2}{R1+R2}\right)\left(1+\frac{R4}{R3}\right) \quad \text{[Equation 10]}$$

Figure 22:
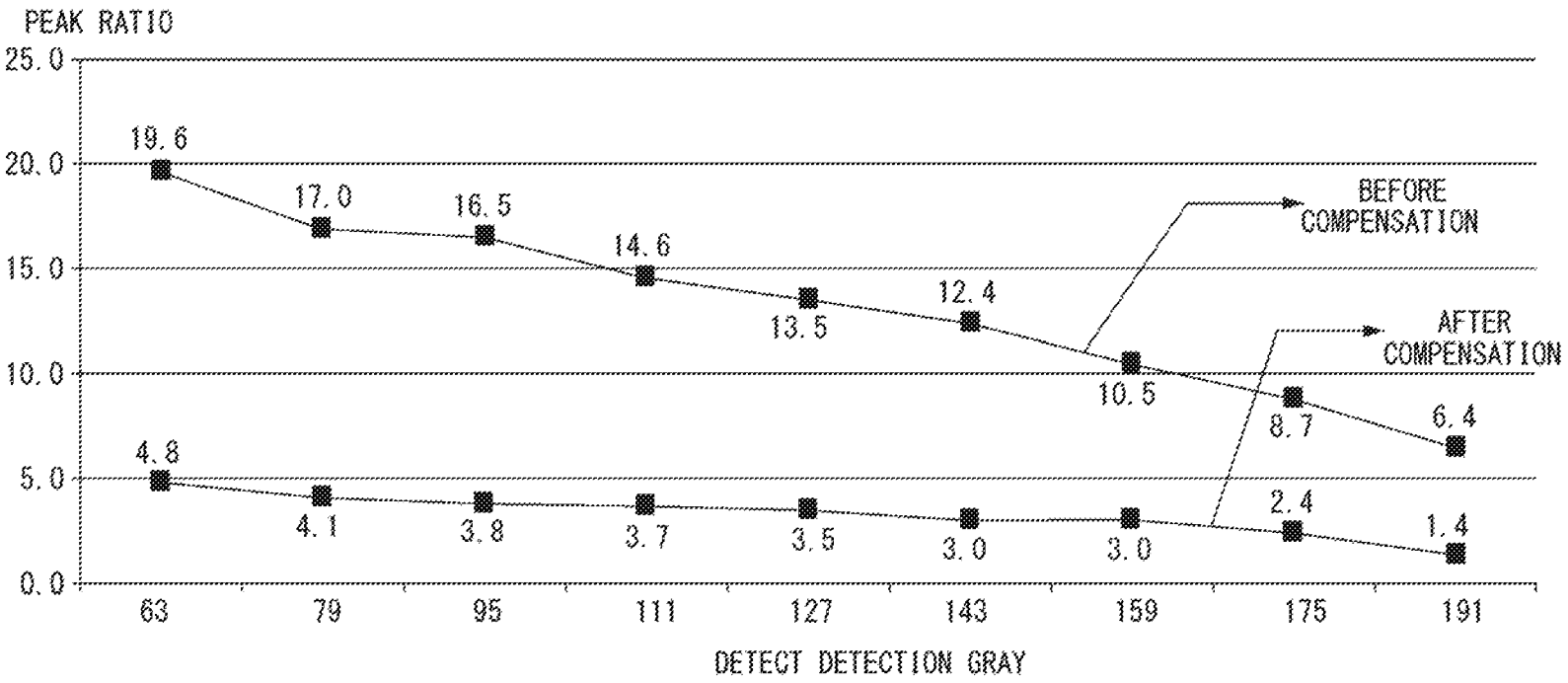
FIG. 22 is a diagram showing an improvement in image quality during a screen change when the feedback compensation power generation unit shown in FIG. 19 is applied to the display device compared to when the DC power generation unit shown in FIG. 14 is applied to the display device.
Figure 23:
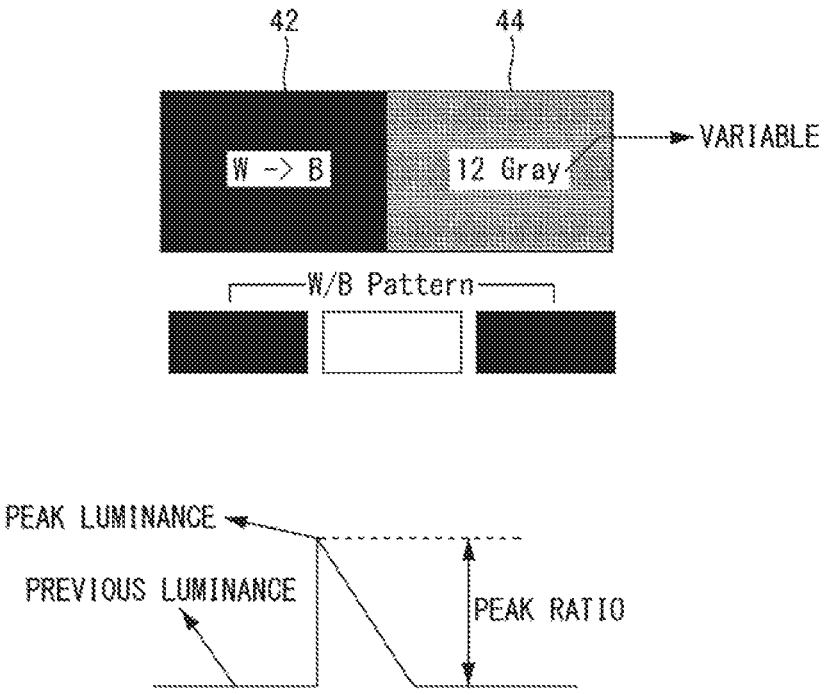
FIG. 23 is a diagram showing a peak ratio measurement condition in a simulation result shown in FIG. 21.

FIG. 22 is a diagram showing an improvement in image quality during a screen change when the feedback compensation power generation unit shown in FIG. 19 is applied to the display device compared to when the direct current power generation unit shown in FIG. 14 is applied to the display device. FIG. 23 is a diagram showing a peak ratio measurement condition in a simulation result shown in FIG. 21.

Referring to FIGS. 22 and 23, the present inventors measured a peak luminance of the middle grayscale luminance of the second screen 44 using a photodiode when the grayscale level of the first screen 42 was changed in a simulation in which a still image of a middle grayscale level (127 Gray) was displayed on the second screen 44 and the grayscale level of the first screen 42 was changed from a white grayscale level W to a black grayscale level B.

In this simulation, for sample 1, by applying the DC power generation unit as shown in FIG. 14, preset VDD was output regardless of the VDD variation ΔVDD of the pixel array AA. In contrast, for sample 2, REFH, REFL, and Vref were changed by reflecting the VDD variation of the pixel array using the feedback compensation power generation unit shown in FIG. 19.

In FIG. 22, the horizontal axis indicates a grayscale level, and the vertical axis indicates a peak luminance ratio (%). The peak luminance ratio (%) is a ratio of original peak luminance Lorigin of the still image to a peak luminance variation ΔL of the still image, i.e., Lorigin/ΔL. In the present disclosure, the peak luminance ratio is also referred to as "peak ratio".

As can be seen in FIG. 22, when a scene change occurs in a portion of the screen, a luminance variation can be reduced in image portions where there is no scene change by changing Vref and the data voltage Vdata in consideration of the VDD variation ΔVDD.

The data voltage Vdata for each grayscale level is determined by the input reference voltages REFH and REFL input to the gamma reference voltage generation unit 148. The present inventors confirmed that the flicker was lessened during a scene change by setting the gains $Gain_L$ and $Gain_H$ of the input reference voltages REFH and REFL for all grayscale levels. Furthermore, the present inventors confirmed that the flicker can be minimized when the gains of the input reference voltages REFH and REFL are differentially applied for each grayscale level, as shown in FIG. 25.

Figure 24:
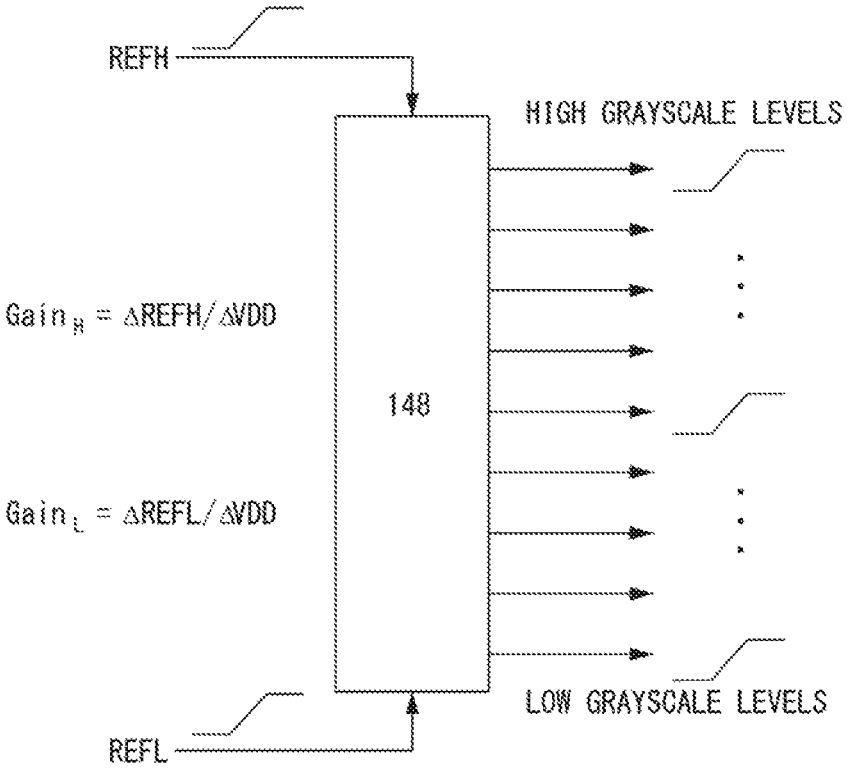
FIG. 24 is a diagram showing an example in which the gain of an input reference voltage shown in FIG. 19 is set equally for all grayscale levels.
Figure 25:
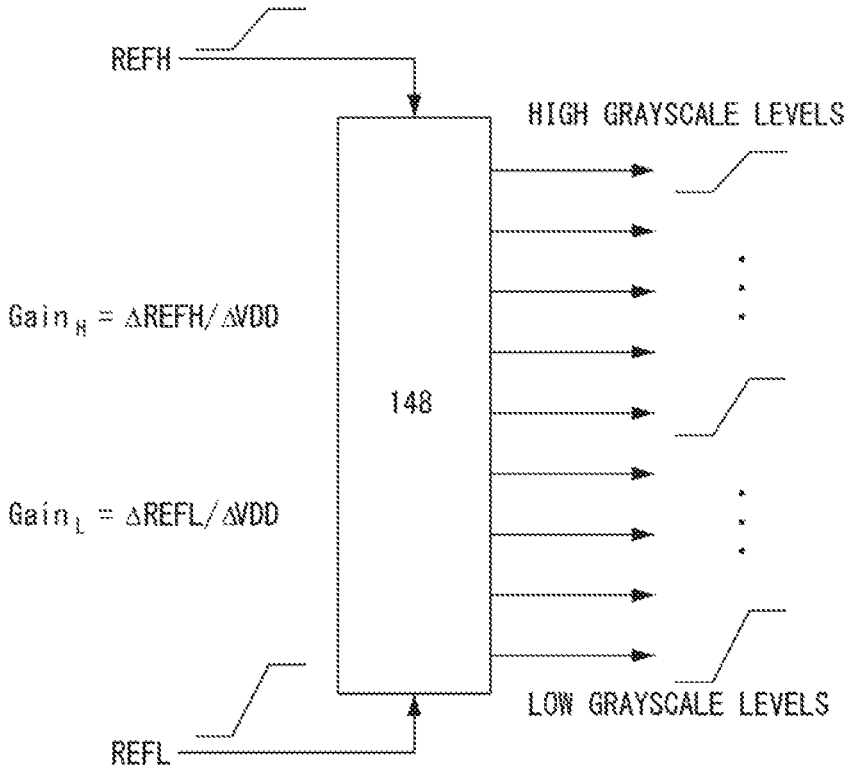
FIG. 25 is a diagram showing an example in which the gain of the input reference voltage shown in FIG. 19 is set differentially for each grayscale level.

In FIGS. 24 and 25, the gain $Gain_L$ or $Gain_H$ of the first input reference voltage REFH is a ratio of a variation of the first input reference voltage (ΔREFH) to a variation of VDD (ΔVDD). The gain Gain of the second input reference voltage REFL is a ratio of a variation of the second input reference voltage (ΔREFL) to a variation of VDD (ΔVDD). This means that the increased gain of the input reference voltage is the large amount of compensation of the input reference voltages REFH and REFL. When the gains $Gain_L$ and $Gain_H$ of the input reference voltages are increased, the defect levels of the graphs shown in FIGS. 24 and 25 are lowered toward zero.

Figure 26:
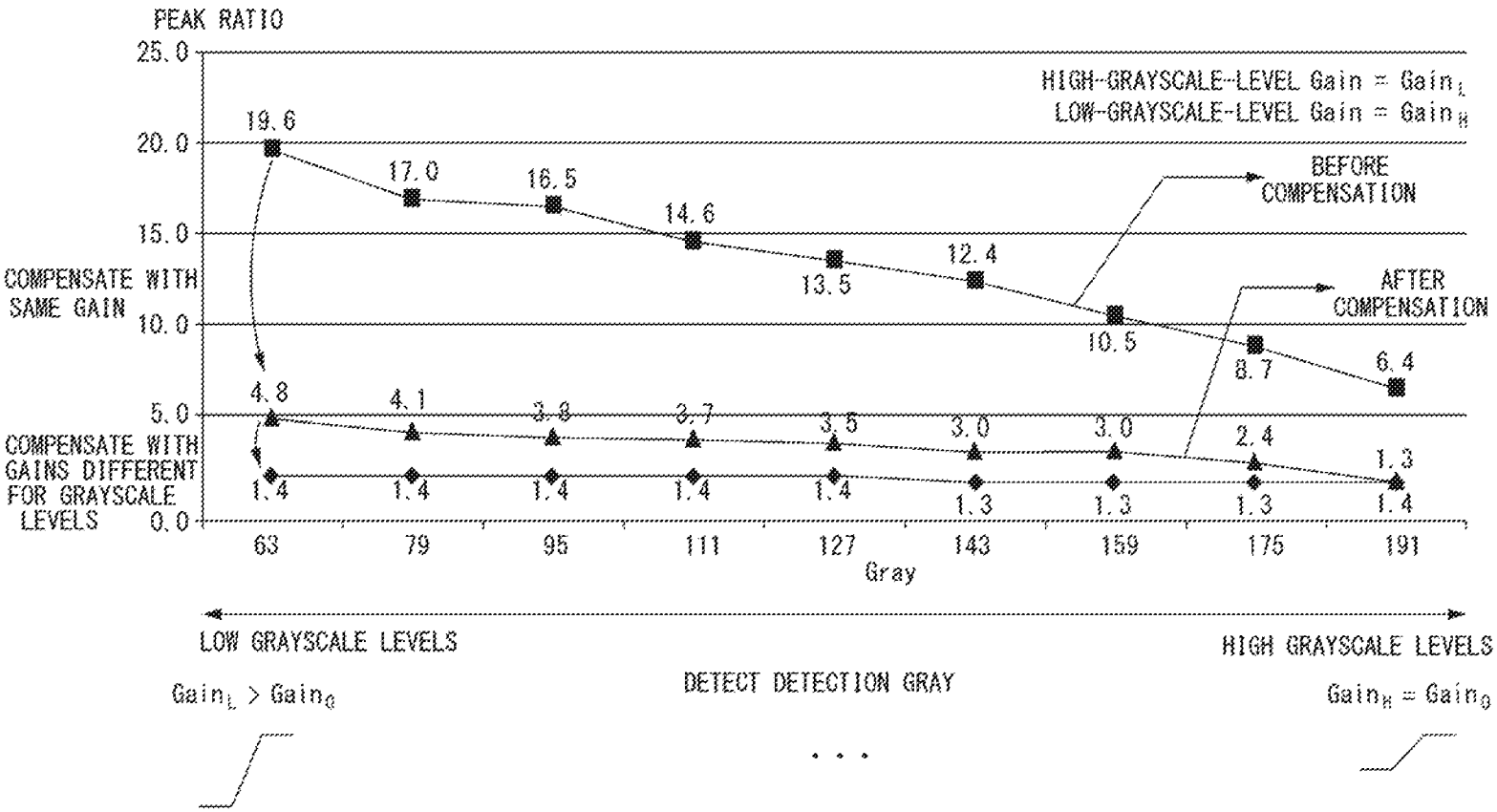
FIG. 26 is a diagram showing a simulation result when a gain at a low grayscale level is higher than that at a high grayscale level.

It can be seen from the graph after compensation of FIG. 22 that the defect level of the peak ratio in all grayscale levels is improved but the peak ratio at a low grayscale level is relatively high compared to that at a high grayscale level. The present inventors focused on this point and thus improved the defect level of the peak ratio to a range from 1.3 to 1.4 as can be seen from the simulation result of FIG. 26 by applying the gain $Gain_L$ of the input reference voltage REFH or REFL at a low grayscale level to be higher than the gain $Gain_H$ of the input reference voltage REFH or REFL at a high grayscale level. In FIG. 26, GainO is a reference (or default) gain.

The gain applied differentially for each grayscale level can be applied to the compensation power generation unit 147 as register setting values of the compensation power generation unit 147. Accordingly, the compensation power generation unit 147 can increase the gains of the first and second input reference voltages REFH and REFL at low grayscale levels to be higher than the gains of the first and second input reference voltages at high grayscale levels by applying the gain of the gamma reference voltage differently for each grayscale level. In examples shown in FIGS. 24 and 25, REFL indicates an input reference voltage at a low grayscale level.

According to the present disclosure, by changing the reference voltage Vref of the pixel circuit and the data voltage in consideration of the pixel driving voltage VDD when a scene change occurs in a portion of a screen and a variation of the pixel driving voltage VDD is generated, it is possible to reduce a luminance variation in an image part where there is no scene change.

Furthermore, according to the present disclosure by setting the gains of the first and second input reference voltages defining the range of the data voltage to be higher at low grayscale levels of the pixel data than at high grayscale levels, it is possible to minimize the luminance variation for all grayscale levels.

It should be noted that the advantageous effects of the present disclosure are not limited to the above-described effects, and other effects that are not described herein will be apparent to those skilled in the art from the following claims.

Through the above description, those skilled in the art will appreciate that various changes and modifications are possible without departing from the technical spirit of the present disclosure. Therefore, the technical scope of the present disclosure should not be limited to the content described in the detailed description of the specification, but should be determined by the claims.

What is claimed is:

1. A display device comprising:

a pixel array comprising a data line through which a data voltage is supplied, a gate line through which a gate signal is supplied, and pixel circuits;

a first power supply line configured to supply a pixel driving voltage to the pixel circuits;

a second power supply line configured to supply a low-potential power supply voltage lower than the pixel driving voltage to the pixel circuits;

a third power supply line configured to supply a reference voltage for initializing the pixel circuits;

a gamma reference voltage generator configured to receive first and second input reference voltages and generate gamma reference voltages having different voltage levels;

a data driver configured to receive the gamma reference voltages, generate the data voltage of pixel data, and supply the data voltage to the data line; and a compensation power generator configured to receive the pixel driving voltage through a feedback line connected to the pixel circuits or the first power supply line, and change the reference voltage and the first and second input reference voltages according to a variation of the pixel driving voltage, wherein the compensation power generator is configured to:

increase the reference voltage when the pixel driving voltage increases; and decrease the reference voltage when the pixel driving voltage decreases.

2. The display device of claim 1, wherein the pixel array includes first and second screens sharing the first, second and third power supply lines, and different content images are displayed on the first and second screens.

3. The display device of claim 1, wherein the compensation power generator is configured to:

increase the first and second input reference voltages when the pixel driving voltage increases; and decrease the first and second input reference voltages when the pixel driving voltage decreases.

4. The display device of claim 1, wherein the first and second input reference voltages have gains that are set differently for each grayscale level of the pixel data.

5. The display device of claim 1, wherein the first and second input reference voltages have gains that are set to be higher at low grayscale levels of the pixel data than at high grayscale levels of the pixel data.

6. The display device of claim 1, wherein the compensation power generator comprises:

a first non-inverting amplifier configured to receive the first input reference voltage and the pixel driving voltage and change the first input reference voltage according to a variation of the pixel driving voltage;

a second non-inverting amplifier configured to receive the second input reference voltage and the pixel driving voltage and change the second input reference voltage according to a variation of the pixel driving voltage; and a third non-inverting amplifier configured to receive the reference voltage and the pixel driving voltage and change the reference voltage according to a variation of the pixel driving voltage.

7. The display device of claim 1, wherein each of the pixel circuits comprises:

a light-emitting element;

a driving element comprising a first electrode connected to the first power supply line, a gate connected to a second node, and a second electrode connected to a third node;

a capacitor connected between a first node and the second node;

a first switch element turned on according to a gate-on voltage of a first scan signal to supply the data voltage to the first node;

a second switch element turned on according to a gate-on voltage of a second scan signal to connect the gate and the second electrode of the driving element;

a third switch element turned on according to a gate-on voltage of an emission control signal to connect the first node to the third power supply line during an initialization period and an emission period, a fourth switch element turned on according to the gate-on voltage of the emission control signal to connect the third node to an anode of the light-emitting element during the initialization period and the emission period; and a fifth switch element turned on according to the gate-on voltage of the second scan signal to connect the third power supply line to the anode of the light-emitting element during the initialization period and a data writing period, wherein the data writing period is set between the initialization period and the emission period.

8. The display device of claim 7, wherein, a pulse of the first scan signal defines the data writing period, a pulse of the second scan signal is inverted into the gate-on voltage before a pulse of the first scan signal to define the initialization period and is inverted into a gate-off voltage simultaneously with the pulse of the first scan signal, and a pulse of the emission control signal is inverted into the gate-off voltage when the first scan signal is inverted into the gate-on voltage and inverted into the gate-on voltage after the first and second scan signals are inverted into the gate-off voltage.

9. A driving method of a display device, the driving method comprising:

supplying a pixel driving voltage, a low-potential power supply voltage, and a reference voltage to pixel circuits;

receiving first and second input reference voltages and generating gamma reference voltages having different voltage levels;

receiving the gamma reference voltages and generating a data voltage of pixel data;

changing the first and second input reference voltages according to a variation of the pixel driving voltage;

increasing the reference voltage when the pixel driving voltage increases; and decreasing the reference voltage when the pixel driving voltage decreases.

10. The driving method of claim 9, further comprising divisionally displaying first and second content images on a screen of a pixel array where the pixel circuits are arranged.

11. The driving method of claim 9, further comprising:

increasing the first and second input reference voltages when the pixel driving voltage increases; and decreasing the first and second input reference voltages when the pixel driving voltage decreases.

12. The driving method of claim 9, further comprising setting gains of the first and second input reference voltages to be higher at low grayscale levels of the pixel data than at high grayscale levels of the pixel data.

13. The driving method of claim 9, further comprising:

receiving the first input reference voltage and the pixel driving voltage and changing the first input reference voltage according to a variation of the pixel driving voltage through a first non-inverting amplifier;

receiving the second input reference voltage and the pixel driving voltage and changing the second input reference voltage according to a variation of the pixel driving voltage through a second non-inverting amplifier, and receiving the reference voltage and the pixel driving voltage and changing the reference voltage according to a variation of the pixel driving voltage through a third non-inverting amplifier.

14. A display device comprising:

a pixel array comprising a data line through which a data voltage is supplied, a gate line through which a gate signal is supplied, and pixel circuits;

a first power supply line configured to supply a pixel driving voltage to the pixel circuits;

a second power supply line configured to supply a low-potential power supply voltage lower than the pixel driving voltage to the pixel circuits;

a third power supply line configured to supply a reference voltage to the pixel circuits;

a compensation power generator configured to:

receive the pixel driving voltage through a feedback line connected to the pixel circuits or the first power supply line;

increase the data voltage and the reference voltage when the pixel driving voltage increases; and decrease the data voltage and the reference voltage when the pixel driving voltage decreases.

* * * * *